US006956546B1

(12) United States Patent
Hashimoto et al.

(10) Patent No.: US 6,956,546 B1
(45) Date of Patent: Oct. 18, 2005

(54) METHOD OF DRIVING AC PLASMA DISPLAY PANEL, PLASMA DISPLAY DEVICE AND AC PLASMA DISPLAY PANEL

(75) Inventors: Takashi Hashimoto, Tokyo (JP); Yasutaka Inanaga, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/684,616

(22) Filed: Oct. 10, 2000

(51) Int. Cl.[7] ..... G09G 3/28
(52) U.S. Cl. ..... 345/60; 345/66; 345/67
(58) Field of Search ..... 345/60, 63, 66–68; 315/169.4; 313/582–587

(56) References Cited

U.S. PATENT DOCUMENTS

| | | | | |
|---|---|---|---|---|
| 3,881,129 | A * | 4/1975 | Nakayama et al. | 345/67 |
| 4,090,109 | A * | 5/1978 | Ryan et al. | 345/60 |
| 5,086,257 | A * | 2/1992 | Gay et al. | 315/169.1 |
| 5,874,932 | A * | 2/1999 | Nagaoka et al. | 345/60 |
| 5,952,783 | A * | 9/1999 | Kuroki et al. | 313/582 |
| 6,140,984 | A * | 10/2000 | Kanazawa et al. | 345/67 |
| 6,278,243 | B1 * | 8/2001 | Yoo | 315/169.4 |
| 6,603,263 | B1 * | 8/2003 | Hashimoto et al. | 313/584 |

FOREIGN PATENT DOCUMENTS

| | | |
|---|---|---|
| JP | 6-12026 | 1/1994 |
| JP | 6-289811 | 10/1994 |
| JP | 7-140922 | 6/1995 |
| JP | 7-160218 | 6/1995 |
| JP | 7-287548 | 10/1995 |
| JP | 9-120777 | 5/1997 |

OTHER PUBLICATIONS

U.S. Appl. No. 09/993,692, filed Nov. 27, 2001, pending.

* cited by examiner

*Primary Examiner*—Jimmy H. Nguyen
(74) *Attorney, Agent, or Firm*—Oblon, Spivak, McClelland, Maier & Neustadt, P.C.

(57) ABSTRACT

Row electrodes Xi (i=1 to n) are arranged over portions close to right and left ends of a PDP, and column electrodes Wj (j=1 to m) are arranged over portions close to upper and lower ends thereof to grade-separately intersect with the row electrodes Xi. The column electrodes Wj and Wm+1−j are connected in common. Row electrodes YL1 to YLn extending over a portion close to the left end and a portion close to the center and row electrodes YR1 to YRn extending over a portion close to the right end and a portion close to the center are arranged alternately with row electrodes X1 to Xn. A scan pulse Vax1 is successively applied to the row electrodes Xi and a voltage Vaw1 based on image data is applied to each column electrode Wj in synchronization with the application of the pulse Vax1 in a first address period. In this period, a subscan pulse Vay1 is applied to the row electrodes YL1 to YLn while the row electrodes YR1 to YRn are set to a ground potential. In a second address period, the voltages applied to the aforementioned row electrodes YL1 to YLn and the row electrodes YR1 to YRn are exchanged. Thus, reduction of the cost for a plasma display device is attained by reducing the number of driving ICs for the column electrodes.

7 Claims, 13 Drawing Sheets

101

METHOD OF DRIVING AC PLASMA DISPLAY PANEL, PLASMA DISPLAY DEVICE AND AC PLASMA DISPLAY PANEL

BACKGROUND OF THE INVENTION

1. Field of the Invention

The present invention relates to a method of driving an AC plasma display panel (hereinafter also referred to as "AC-PDP"), an AC-PDP and a plasma display device, and more particularly, it relates to a technique for reducing the cost for a plasma display device.

2. Description of the Background Art

Various researches are made on plasma display panels (PDP) as thin-type television or display monitors. AC-PDPs having memory functions include a surface discharge AC-PDP. The structure of this AC-PDP is now described with reference to FIG. 10.

FIG. 10 is a perspective view extracting and showing part of the structure of an AC-PDP 101 according to first background art. For example, Japanese Patent Application Laid-Open No. 7-140922 (1995) or Japanese Patent Application Laid-Open No. 7-287548 (1995) discloses an AC-PDP having such a structure. As shown in FIG. 10, the AC-PDP 101 comprises a front glass substrate 102 serving as a display surface and a rear glass substrate 103 opposed to the front glass substrate 102 through discharge spaces 111. While the glass substrates 102 and 103 are so arranged that the top portions of barrier ribs 110 are in contact with a dielectric layer 106A described later, FIG. 10 illustrates the glass substrates 102 and 103 in a separated state for convenience of illustration.

On a surface of the front glass substrate 102 closer to the discharge spaces 111, n row electrodes 104 and n row electrodes 105 (both are transparent electrodes) paired with each other are extended/formed. When metal auxiliary electrodes (also referred to as "bus electrodes") 104*a* and 105*a* having low impedance for supplying a current from a circuit part are provided on partial surfaces of the row electrodes 104 and 105 respectively as shown in FIG. 10, the respective ones are referred to as "row electrodes 104" and "row electrodes 105" inclusive of the metal auxiliary electrodes respectively. The dielectric layer 106 is formed to cover both row electrodes 104 and 105. A protective film 107 of a dielectric substance such as MgO (magnesium oxide) may be formed on the surface of the dielectric layer 106 by a method such as vapor deposition as shown in FIG. 10, and the dielectric layer 106 and the protective film 107 are also generically referred to as "dielectric layer 106A" in this case.

On the surface of the rear glass substrate 103 closer to the discharge spaces 111, on the other hand, m column electrodes 108 are extended/formed to (grade-separately) intersect with the row electrodes 104 and 105, and the barrier ribs 110 are extended/formed between the adjacent ones of the column electrodes 108 in parallel with the column electrodes 108. The barrier ribs 110 separate respective discharge cells from each other while supporting the AC-PDP 101 not to be crushed under the atmospheric pressure.

A phosphor layer 109R for emitting red (R) light, a phosphor layer 109G for emitting green (G) light and a phosphor layer 109B for emitting blue (B) light (these phosphor layers 109R, 109G and 109B are also referred to as "phosphor layers 109") are arranged in U-shaped trenches defined by the aforementioned surface of the rear glass substrate 103 and opposite side wall surfaces of the adjacent barrier ribs 110 in prescribed order to cover the column electrodes 108 in the form of stripes. There is also an AC-PDP having such a structure that a dielectric layer is provided on the aforementioned surface of the rear glass substrate 103 to cover the column electrodes 108 so that the barrier ribs 110 and the phosphor layers 109 are arranged on this dielectric layer.

The front glass substrate 102 and the rear glass substrate 103 having the aforementioned structures are sealed to each other along peripheral edge portions (not shown in FIG. 10) so that spaces (the discharge spaces 111) between the glass substrates 102 and 103 are filled with discharge gas such as an Ne—Xe gas mixture or an He—Xe gas mixture under pressure below the atmospheric pressure. In the AC-PDP 101, the grade-separate intersection between each pair of row electrodes 104 and 105 and each column electrode 108 defines a discharge cell (also referred to as "luminous cell" or "display cell"). In a full color display PDP such as the AC-PDP 101, three discharge cells for emitting red light, green light and blue light form a single pixel. In this case, FIG. 10 shows the structure of the AC-PDP 101 for the single pixel.

In the following description, a transverse line of a luminous color obtained by lighting luminous cells of all luminous colors or arrangement of pixels necessary for displaying the transverse line is referred to as "display line". The AC-PDP 101 can light or select (discharge cells belonging to) a single display line when applying a prescribed voltage to a pair of row electrodes 104 and 105. Such arrangement that three discharge cells forming a single pixel are transversely aligned with each other may also be referred to as "stripe arrangement".

In the AC-PDP 101, the discharge spaces 111, divided by the barrier ribs 110, extending along the longitudinal direction of the column electrodes 108 can be separated into (i) "luminous area" or "display area" forming discharge cells to which the pairs of electrodes 104 and 105 belong and (ii) "non-luminous area" or "non-display area" between an adjacent pair of electrodes 104 and 105 (or each adjacent area of a plurality of discharge cells arranged along the aforementioned longitudinal direction) irrelevant to display luminescence of the PDP. In the following description, the structure forming the non-luminous area in the discharge spaces 111, i.e., the structure between discharge cells adjacent along the longitudinal direction of the column electrodes 108 is referred to as "non-discharge cell (or non-luminous cell or non-display cell)" with respect to the luminous area forming the discharge cell for convenience.

Among gaps between the adjacent row electrodes 104 and 105, (i) a gap between two row electrodes 104 and 105 forming discharge in the discharge cell in a paired manner is referred to as "discharge gap DG" while (ii) a gap between two opposite row electrodes 104 and 105 belonging to adjacent discharge cells respectively is referred to as "non-discharge gap NG". While the non-discharge cell has the discharge space 111 (non-discharge area) defined by the intersection between two row electrodes 104 and 105 (belonging to adjacent discharge cells respectively) and the column electrode 108 similarly to the discharge cell, the distance between the non-discharge gaps NG is so widely set as not to cause discharge in the AC-PDP 101.

An AC-PDP 201 according to second background art is now described with reference to FIGS. 11 and 12. FIG. 11 is a plan view of the AC-PDP 201 according to the second background art, and FIG. 12 is a longitudinal sectional view taken along the line I—I in FIG. 11. For example, Japanese Patent Application Laid-Open No. 6-12026 (1994) discloses an AC-PDP having such a structure. As shown in FIGS. 11 and 12, the AC-PDP 201 comprises a front glass substrate 202 serving as a display surface and a rear glass substrate 203 opposed to the front glass substrate 202 through discharge spaces 211. Row electrodes 204 and 205 are alternately formed on the surface of the front glass substrate 202 closer to the discharge spaces 211 at regular intervals. The row electrodes 204 and 205 may be formed by combination of transparent electrodes and bus electrodes similarly to the aforementioned AC-PDP 101, and the electrodes consisting of transparent electrodes and bus electrodes are also referred to as "row electrodes 204 and 205" in this case. A dielectric layer 206 and a protective film 207 (also generically referred to as "dielectric layer 206A") are successively formed on the row electrodes 204 and 205.

Column electrodes 208 are extended/formed on the rear glass substrate 203 to (grade-separately) intersect with the row electrodes 204 and 205, and a dielectric layer 212 is formed to cover the column electrodes 208. The glass substrates 202 and 203 are opposed to each other through barrier ribs 210. As shown in FIG. 11, the space between the glass substrates 202 and 203 is divided into a plurality of hexagonal discharge spaces 211 by the glass substrates 202 and 203 and the barrier ribs 210. The barrier ribs 210 are so arranged that the centers of the respective discharge spaces 211 substantially match with the intersections of the gaps between the adjacent row electrodes 204 and 205 and the column electrodes 208 in the plan view shown in FIG. 11. In the AC-PDP 201, the respective gaps between the adjacent row electrodes 204 and 205 define discharge gaps DG, with no presence of non-discharge gaps, i.e., non-discharge cells. Thus, each discharge cell defined by the intersection between each pair of row electrodes 204 and 205 and each column electrode 208 is enclosed with the barrier ribs 210 and separated from adjacent discharge cells in the AC-PDP 201. As shown in FIG. 11, each column electrode 208 consists of a part opposed to the discharge spaces 211 and a part opposed to the barrier ribs 210, and these parts are alternately repeated at a pitch half that of the discharge cells arranged along the longitudinal direction of the column electrodes 208.

Phosphor layers 209 of the same luminous color are applied onto the dielectric layer 212 and to (parts of) the side wall surfaces of the barrier ribs 210 in the plurality of discharge cells arranged along each column electrode 208. In other words, a plurality of discharge cells for a luminous color of red (R), green (G) or blue (B) are arranged along each column electrode 208. In other words, each column electrode 208 corresponds to a single luminous color (or display color). In the AC-PDP 210, therefore, three discharge cells (FIG. 11 shows exemplary arrangement by symbols R, G and B) for respective luminous colors arranged in the form of a delta form a pixel for white display, and such arrangement of the discharge cells may also be referred to as "delta arrangement". The remaining structure such as discharge gas is similar to that of the first background art.

The display operation principle of the aforementioned AC-PDP 101 (or 201) is now described. First, a voltage pulse is applied across the pair of row electrodes 104 and 105 (or 204 and 205) for causing discharge. Ultraviolet rays resulting from this discharge excite the phosphor layers 109 (209) so that the discharge cells luminesce. Electrons and ions generated in the discharge spaces during this discharge move toward the row electrodes 104 and 105 (204 and 205) having opposite polarity thereto and are stored on the surface of the dielectric layer 106A (206A) located on the row electrodes 104 and 105 (204 and 205). Charges such as the electrons and ions thus stored on the surface of the dielectric layer 106A (206A) are referred to as "wall charges".

An electric field formed by the wall charges acts to weaken an electric field formed by the voltage applied across the row electrodes 104 and 105 (204 and 205), and hence the discharge rapidly disappears following formation of the wall charges. When applying a voltage pulse reversed in polarity across the row electrodes 104 and 105 (204 and 205) after the discharge disappears, discharge can be caused again since an electric field formed by superposition of the applied electric field and an electric field formed by wall charges is substantially applied to the discharge spaces. Thus, once discharge is caused, discharge can be caused again by applying a lower applied voltage (hereinafter also referred to as "sustain voltage") than the firing voltage, whereby discharge can be stationarily sustained by successively applying sustain voltages (hereinafter also referred to as "sustain pulses") reversed in polarity across the row electrodes 104 and 105 (204 and 205). This discharge is hereinafter referred to as "sustain discharge".

This sustain discharge is maintained so far as the sustain pulses are applied until the wall charges disappear. An operation of making the wall charges disappear is referred to as "erasing", while an operation of forming wall charges on the dielectric layer 106A (206A) in the initial stage of discharge is referred to as "writing". Therefore, characters, figures, images and the like can be displayed by first performing writing on arbitrary discharge cells on the screen of the AC-PDP and thereafter performing sustain discharge. Further, motion pictures can also be displayed by performing writing, sustain discharge and erasing at a high speed.

A more specific method of driving the conventional PDP is now described with reference to FIG. 13. For example, Japanese Patent Application Laid-Open No. 7-160218 (1995) (or Japanese Patent No. 2772753) discloses a method of driving the conventional AC-PDP 101 (see FIG. 10). FIG. 13 is a timing chart showing waveforms of driving voltages in a single subfield (SF) in the driving method. In the following description, each of n row electrodes 104 is referred to as "row electrode Xi" (i=1 to n) and each of n row electrodes 105 is referred to as "row electrode Yi" (i=1 to n), while n row electrodes Y1 to Yn are collectively referred to as "row electrodes Y" assuming that all row electrodes Y1 to Yn are driven with a single driving signal (voltage). Further, each of m column electrodes 108 is referred to as "column electrode Wj" (j=1 to m).

The subfield (SF) shown in FIG. 13 is one of a plurality of periods obtained by dividing a single frame (F) for image display. The subfield is further divided into three periods, i.e., "reset period", "address period" and "sustain discharge period (also referred to as a sustain period or a display period)".

In the "reset period", a display history at an end point of a preceding subfield is erased while priming particles for improving discharge probability in the subsequent address period are supplied. More specifically, a full writing pulse Vp having a voltage value capable of causing self-erase discharge on the trailing edge thereof is applied across all row electrodes X1 to Xn and row electrodes Y thereby erasing the display history. At this time, a voltage pulse Vp1 is applied to the column electrode Wj.

In the "address period", only discharge cells to be displayed are selectively discharged by selecting a matrix for forming "address discharge" on the discharge cells. More specifically, a scan pulse Vxg (voltage value Vxg (<0)) is successively applied to the row electrodes Xi and a voltage pulse VwD (voltage value VwD (>0)) based on image data is applied to the column electrode(s) Wj in the discharge cell(s) to be lighted, thereby causing "writing discharge" between the column electrode Wj and the row electrode Xi, as shown in FIG. 13. During the address period, a subscan pulse Vysc (voltage value Vysc (>0)) is applied to the row electrodes Y. At this time, a potential difference (Vysc−Vxg) is applied across the row electrode Xi and the row electrode Yi. This potential difference (Vysc−Vxg), not starting discharge itself, can immediately cause (transfer) "writing sustain discharge" between the row electrodes Xi and Yi with a trigger of the preceding writing discharge. Due to such address discharge, positive or negative wall charges are stored on the surface of the dielectric layer 106A (see FIG. 10) located on the discharge cell(s) in a quantity capable of causing sustain discharge only with later application of a sustain pulse Vs.

Thus, the "address discharge" is formed by (i) "writing discharge" selectively generated between the row electrode Xi and the column electrode Wj and (ii) "writing sustain discharge" triggered by the "writing discharge" and caused between the row electrode Xi and the row electrode Yi.

On the other hand, the discharge cells turned out in image display (i.e., in the sustain discharge period) are not made to cause address discharge and hence no discharge is caused between the row electrodes Xi and Yi of the discharge cells and no wall charges are stored as a matter of course.

The sustain discharge period follows the address period. In the sustain discharge period, the sustain pulse Vs is applied across the row electrodes Xi and Yi, thereby maintaining sustain discharge during this period in the discharge cell(s) subjected to the aforementioned writing. During the sustain discharge period, a voltage Vs2 set to substantially half the voltage value Vs of the sustain pulse Vs is applied to the column electrode Wj, so that sustain discharge can be stably started upon transition from the address period to the sustain period.

In the conventional AC-PDP and the driving method therefor, however, a column of discharge cells arranged along the vertical direction of the screen correspond to a single column electrode (data line). When the number of the column electrodes is increased following improvement in precision of the PDP or the like, therefore, the number of driving circuits (generally integrated) for supplying prescribed voltages to the column electrodes is also increased and hence the cost for the plasma display device is disadvantageously increased.

SUMMARY OF THE INVENTION (1) According to a first aspect of the present invention, a method of driving an AC plasma display panel drives an AC plasma display panel comprising an address electrode including t (t: integer of at least 2) strip portions, t discharge cells belonging to the t strip portions respectively, a scan electrode including t strip portions belonging to the t discharge cells in one-to-one correspondence and arranged to grade-separately intersect with the strip portions of the address electrode, a sustain electrode including t strip portions belonging to the t discharge cells in one-to-one correspondence and paired with the strip portions of the scan electrode and a dielectric substance covering at least one of the scan electrode and the sustain electrode by applying a prescribed voltage to the strip portions of the address electrode in common, applying a prescribed voltage to each strip portion of the scan electrode and applying a first voltage to one of the t strip portions of the sustain electrode belonging to a single discharge cell among the t discharge cells while applying a second voltage to the remaining all of the strip portions of the sustain electrode for forming desired discharge only in the single discharge cell.

According to the first aspect, it is possible to form the desired discharge only in a prescribed discharge cell by setting the potential difference between strip portions of the scan electrode and the sustain electrode belonging to the prescribed discharge cell to a value capable of forming desired discharge and by setting the potential difference between the strip portions of the remaining discharge cells to a value forming no discharge also when the same voltage is applied to the t strip portions of the address electrode. Therefore, a single driving circuit can supply the same voltage to the t strip portions, whereby it is possible to provide a plasma display, device reduced in cost due to reduction of the number of driving circuits as compared with a plasma display device provided with a plurality of driving circuits for the strip portions of the address electrode respectively.

(2) According to a second aspect of the present invention, the t strip portions of the scan electrode form a single strip electrode.

According to the second aspect, the aforementioned effect (1) can be attained when t discharge cells belong to a single scan electrode (strip electrode).

(3) According to a third aspect of the present invention, a first potential difference between the strip portion of the sustain electrode supplied with the first voltage and the strip portion of the scan electrode paired with the strip portion supplied with the first voltage is larger than a second potential difference between the strip portion of the sustain electrode supplied with the second voltage and the strip portion of the scan electrode paired with the strip portion supplied with the second voltage.

According to the third aspect, it is possible to render the aforementioned desired discharge formable only in the discharge cell belonging to the strip portion supplied with the first voltage while reliably preventing discharge formation in the remaining discharge cells.

(4) According to a fourth aspect of the present invention, the method of driving an AC plasma display panel sets the second potential difference substantially to zero.

According to the fourth aspect, discharge formation in the aforementioned remaining discharge cells can be more reliably prevented as compared with the driving method according to the third aspect.

(5) According to a fifth aspect of the present invention, the method of driving an AC plasma display panel successively selects one of the t strip portions of the sustain electrode and applying the first voltage while applying the second voltage to the remaining all of the strip portions of the sustain electrode in a period when the prescribed voltage is applied to the scan electrode.

According to the fifth aspect, any of the aforementioned effects (1) to (4) can be attained.

(6) According to a sixth aspect of the present invention, the AC plasma display panel has a plurality of scan electrodes and a plurality of sustain electrodes respectively, and the method, in a period for applying the first voltage to each one of the t strip portions of each of the plurality of sustain electrodes in common, successively selects one of the strip portions of the scan electrodes paired with the strip portions supplied with the first voltage and applies the prescribed voltage.

According to the sixth aspect, any of the aforementioned effects (1) to (4) can be attained.

(7) According to a seventh aspect of the present invention, the method of driving an AC plasma display panel forms, after the period, first auxiliary discharge in the discharge cell to which the strip portion of the sustain electrode supplied with the second voltage in the period belongs between strip portions of the scan electrode and the address electrode.

According to the seventh aspect, wall charges formed above the scan electrode and above the address electrode can be reduced in the discharge cell to which the strip portion of the sustain electrode supplied with the second voltage in the aforementioned period belongs. Therefore, it is possible to more reliably form desired discharge at the strip portion of the sustain electrode subsequently selected and supplied with the first voltage. Further, the margin of each applied voltage in the aforementioned next period can be enlarged.

(8) According to an eighth aspect of the present invention, the method of driving an AC plasma display panel forms, after the period, second auxiliary discharge in the discharge cell selected and supplied with the first voltage for forming the desired discharge in the period between strip portions of the scan electrode and the sustain electrode.

According to the eighth aspect, wall charges stored above the scan electrode and above the sustain electrode can be amplified/stabilized in the discharge cell formed with the aforementioned desired discharge in the aforementioned period. Therefore, sustain discharge can be reliably formed through the wall charges. Further, the margin of each applied voltage in the aforementioned next period can be enlarged.

(9) According to a ninth aspect of the present invention, an AC plasma display panel comprises an address electrode including t (t: integer of at least 2) strip portions, t discharge cells, having discharge gaps capable of forming desired discharge, belonging to the t strip portions respectively, a scan electrode including t strip portions belonging to the t discharge cells in one-to-one correspondence and arranged to grade-separately intersect with the strip portions of the address electrode, a sustain electrode including t strip portions belonging to the t discharge cells in one-to-one correspondence and paired with the strip portions of the scan electrode, a dielectric substance covering at least one of the scan electrode and the sustain electrode and a plurality of non-discharge cells, having non-discharge gaps harder to form discharge than the discharge gaps, arranged on a same plane and belonging to the address electrode, while the t discharge cells are arranged on the same plane and arranged adjacently to each other through at least one non-discharge cell at least in a direction parallel to a display line, the AC plasma display panel further comprises a plurality of barrier ribs separating the non-discharge cells from the discharge cells or the non-discharge cells at least along a direction intersecting with the display line, and at least two adjacent ones of strip portions of the address electrode are integrated with each other extending over the non-discharge cells and the discharge or non-discharge cells separated by the barrier ribs.

According to the ninth aspect, the number of the strip portions of an address electrode can be reduced as compared with an AC plasma display panel provided with strip portions of an address electrode for non-discharge or discharge cells and non-discharge cells separated from each other by barrier ribs respectively. Thus, the cost for the AC plasma display panel can be reduced. Further, the width of an electrode pattern is enlarged as a result of integration, whereby alignment in a step of forming the address electrode is simplified and no high process accuracy is required in this step.

(10) According to a tenth aspect of the present invention, a plasma display device comprises an AC plasma display panel and a driving unit for the AC plasma display panel, while the AC plasma display panel comprises an address electrode including t (t: integer of at least 2) strip portions, t discharge cells belonging to the t strip portions respectively, a scan electrode including t strip portions belonging to the t discharge cells in one-to-one correspondence and arranged to grade-separately intersect with the strip portions of the address electrode belonging to the discharge cells, a sustain electrode including t strip portions belonging to the t discharge cells in one-to-one correspondence and paired with the strip portions of the scan electrode and a dielectric substance covering at least one of the scan electrode and the sustain electrode, and the driving unit applies a prescribed voltage to the strip portions of the address electrode in common, applies a prescribed voltage to each strip portion of the scan electrode, and applies a first voltage to one of the t strip portions of the sustain electrode belonging to a single discharge cell among the t discharge cells while applying a second voltage to the remaining all of the strip portions of the sustain electrode for forming desired discharge only in the single discharge cell.

According to the tenth aspect, it is possible to provide a plasma display device capable of exhibiting any of the aforementioned effects (1) to (9).

(11) According to an eleventh aspect of the present invention, the AC plasma display panel further comprises a plurality of non-discharge cells arranged on a same plane and belonging to the address electrode, each discharge cell has a discharge gap capable of forming desired discharge while each non-discharge cell has a non-discharge gap harder to form discharge than the discharge gap, the t discharge cells are arranged on the same plane and arranged adjacently to each other through at least one non-discharge cell at least in a direction parallel to a display line, the AC plasma display panel further comprises a plurality of barrier ribs separating the non-discharge cells from the discharge cells or the non-discharge cells at least along a direction intersecting with the display line, and at least two adjacent ones of strip portions of the address electrode are integrated with each other extending over the non-discharge cells and the discharge or non-discharge cells separated by the barrier ribs.

According to the eleventh aspect, it is possible to provide a plasma display device capable of exhibiting any of the aforementioned effects (1) to (9).

A first object of the present invention is to provide a method of driving an AC plasma display panel enabling reduction of the cost for a plasma display device also when the number of column electrodes is increased.

A second object of the present invention is to provide an AC plasma display panel having an optimum structure for attaining the aforementioned first object.

In addition, a third object of the present invention is to provide a plasma display device comprising an AC plasma display panel driven by a driving method capable of attaining the aforementioned first object or an AC plasma display panel capable of attaining the second object.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

A. Structure of Plasma Display Device 60

Figure 1:
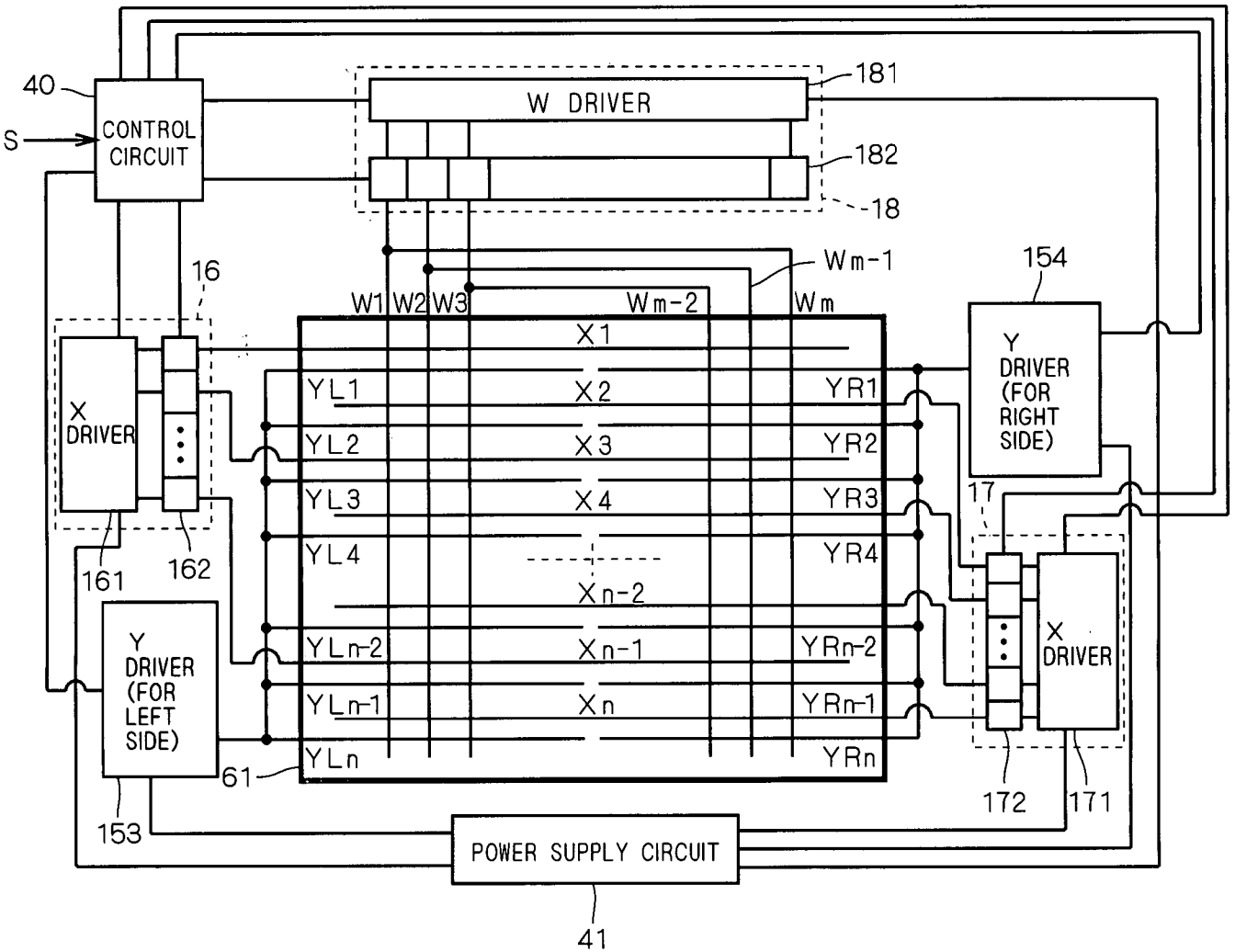
FIG. 1 is a block diagram showing the overall structure of a plasma display device according to an embodiment 1 of the present invention.

FIG. 1 is a block diagram showing the overall structure of a plasma display device 60 according to an embodiment 1 of the present invention. As shown in FIG. 1, the plasma display device 60 comprises an AC-PDP 61, driving circuits 16, 17, 153 and 154 for supplying prescribed voltages to row electrodes of the AC-PDP 61, a driving circuit 18 for supplying a prescribed voltage to column electrodes, a control circuit 40 controlling the driving circuits 16, 17, 153, 154 and 18 and a power supply circuit 41 generating the prescribed voltages and supplying the same to the driving circuits 16, 17, 153, 154 and 18. A driving unit of the plasma display device 60 includes the driving circuits 16, 17, 153, 154 and 18. The respective elements are now described. FIG. 1 typically illustrates only the arrangement relation of the respective electrodes of the AC-PDP 61 as viewed from the side of a display surface, and the remaining elements such as barrier ribs and phosphors are similar to those of the conventional AC-PDP (e.g., the AC-PDP 101 shown in FIG. 10). In the following description, right, left, upper and lower directions are described with reference to the plasma display device 60 as viewed from the side of the display surface of the AC-PDP 61 in coincidence with the upper, lower, right and left directions in FIG. 1.

The AC-PDP 61, based on the structure of the conventional AC-PDP, has such a structure that one of two row electrodes paired with each other is horizontally divided at the center of the PDP. More specifically, (a) n row electrodes X1 to Xn (an arbitrary one of the n row electrodes X1 to Xn is hereinafter also referred to as "row electrode Xi" (i=1 to n)) are arranged over portions close to the right and left ends of this PDP in parallel with each other, and m column electrodes W1 to Wm (an arbitrary one of the m column electrodes W1 to Wm is hereinafter also referred to as "column electrode Wj" (j=1 to m)) are arranged over portions close to the upper and lower ends of this PDP in parallel with each other in a direction (grade-separately) intersecting with the row electrodes X1 to Xn. In particular, n row electrodes YL1 to YLn (an arbitrary one of the n row electrode YL1 to YLn is hereinafter also referred to as "row electrode YLi" (i=1 to n)) parallel to the row electrodes X1 to Xn respectively are arranged over a portion close to the left end of this PDP and a portion close to the center, while n row electrodes YR1 to YRn (an arbitrary one of the n row electrodes YR1 to YRn is hereinafter also referred to as "row electrode YRi" (i=1 to n)) parallel to the row electrode X1 to Xn respectively are arranged over a portion close to the right end of this PDP and a portion close to the center. The row electrodes YL1 to YLn and YR1 to YRn and the row electrodes X1 to Xn are alternately arranged. In this case, the row electrodes YL1 to YLn and the left m/2 column electrodes W1 to Wm/2 among the m column electrodes W1 to Wm (grade-separately) intersect with each other, and the row electrodes YR1 to YRn and the right m/2 column electrodes Wm/2+1 to Wm among the m column electrodes W1 to Wm (grade-separately) intersect with each other. In this case, each of the row electrodes YLi and YRi is paired with the row electrode Xi (the respective pairs are hereinafter also referred to as "pair of (row) electrodes Xi and YLi" and "pair of (row) electrodes Xi and YRi"), for defining a single discharge cell (also referred to as "luminous cell" or "display cell") by each (grade-separate) intersection between the pair of row electrodes and the column electrode. In this case, a discharge cell defined by the pair of row electrodes Xi and YLi (or YRi) and the column electrode Wj is expressed as "discharge cell of a matrix (i,j)". In the following description, the row electrodes YL1 to YLn are also referred to as "left-side row electrodes YL1 to YLn", and the row electrodes YR1 to YRn are also referred to as "right-side row electrodes YR1 to YRn".

Figure 10:
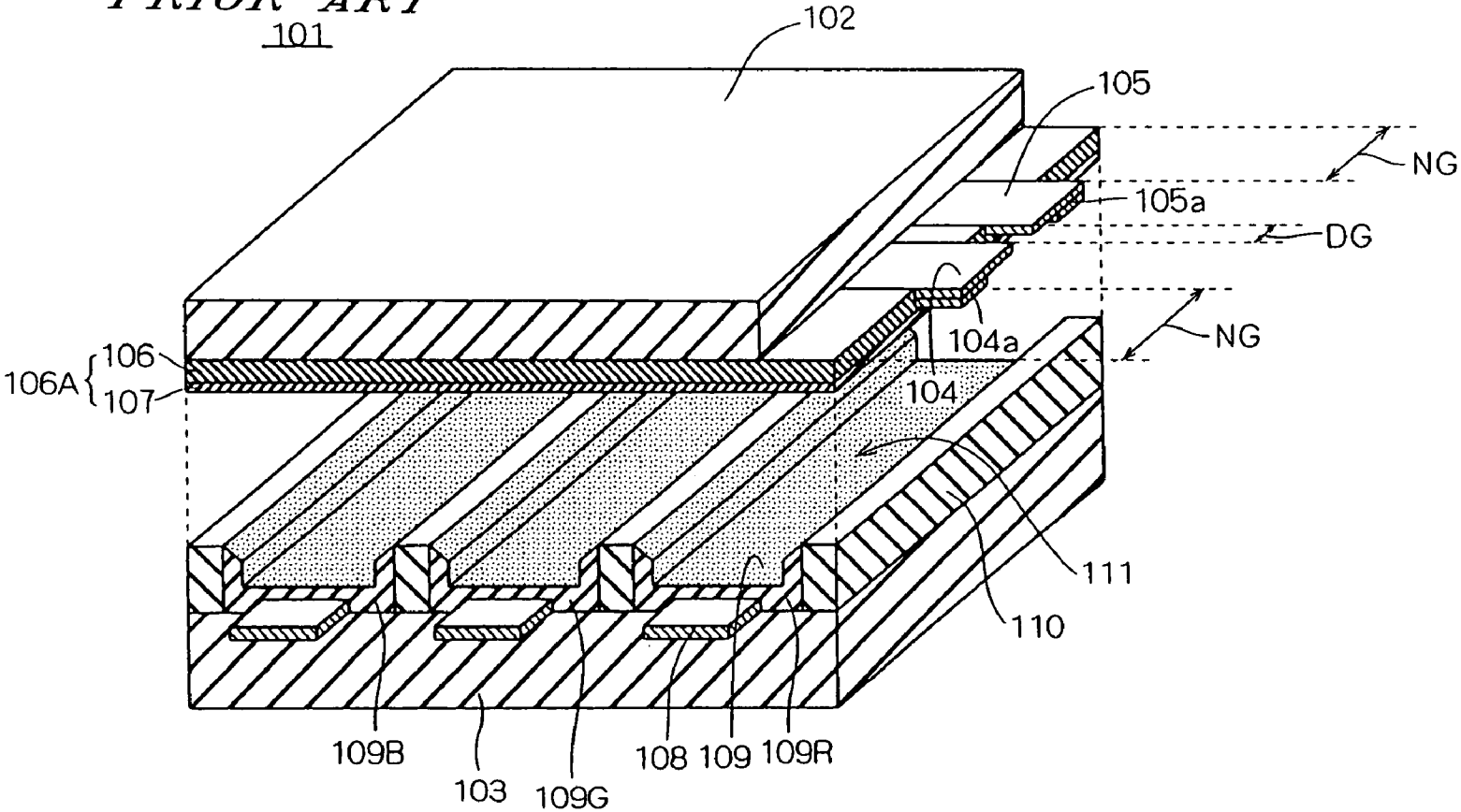
FIG. 10 PRIOR ART
FIG. 10 is a perspective view showing the structure of an AC plasma display panel according to firs background art.
Figure 13:
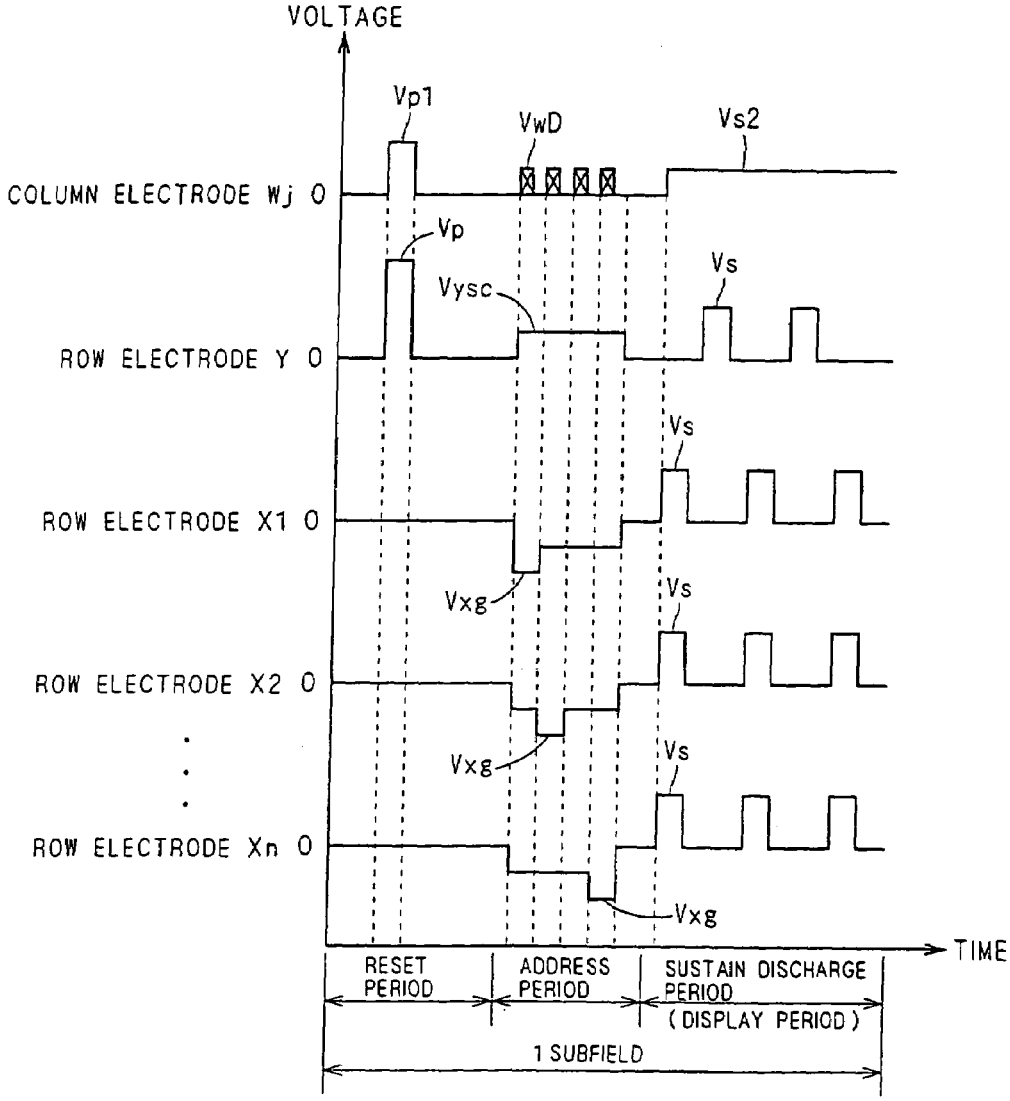
FIG. 13 PRIOR ART
FIG. 13 is a timing chart for illustrating a method of driving the conventional AC plasma display panel.

In the AC-PDP 61, a dielectric substance (layer) (not shown in FIG. 1; refer to the dielectric layer 106 (or 106A) shown in FIG. 10) is arranged to cover the row electrodes X1 to Xn and the row electrodes YL1 to YLn and YR1 to YRn. When at least either the row electrodes X1 to Xn or the row electrodes YL1 to YLn and YR1 to YRn are covered with the dielectric substance, a memory function resulting from wall charges in the AC-PDP can be attained and the aforementioned driving method separating the address period and the sustain period shown in FIG. 13 is applicable.

The driving circuit 18 consists of a W driver 181 and driving ICs 182. The W driver 181 receives a control signal from the control circuit 40 described later and a supply voltage from the power supply circuit 41 and generates a prescribed voltage pulse. The driving ICs 182 output the aforementioned prescribed voltage pulse generated in the W driver 181 on the basis of the control signal from the control circuit 40.

As shown in FIG. 1, the column electrodes W1 and Wm are connected to a prescribed output terminal of the driving ICs 182 in common, and the column electrodes W2 and Wm−1 are similarly connected to another prescribed output terminal of the driving ICs 182. In other words, the column electrodes Wj and Wm+1−j located on line-symmetrical positions about the boundary between the column electrodes Wm/2 and Wm/2+1 are connected to a prescribed output terminal in common in the plasma display device 60. Therefore, the aforementioned prescribed voltage pulse is applied to the column electrodes Wj and Wm+1−j in common.

The driving circuit 16 consists of an X driver 161 equivalent to the aforementioned W driver 181 and driving ICs 162 equivalent to the aforementioned driving ICs 182. The X driver 161 receives a control signal from the control circuit 40 and a supply voltage from the power supply circuit 41 and generates a prescribed voltage pulse. A plurality of output terminals of the driving ICs 162 are connected to odd ones of the row electrodes X1 to Xn respectively, so that the driving ICs 162 scan and apply the prescribed voltage pulse generated in the X driver 161 on the basis of the control signal from the control circuit 40 to the aforementioned odd row electrodes. On the other hand, the driving circuit 17 consists of an X driver 171 equivalent to the X driver 161 and driving ICs 172 equivalent to the driving ICs 162, and output terminals of the driving ICs 172 are connected to even ones of the row electrodes X1 to Xn.

The driving circuits 153 and 154 consist of Y drivers equivalent to the aforementioned W driver 181 (therefore, the Y drivers are also referred to as "Y drivers 153 and 154" with the same reference numerals). In particular, the row electrodes YL1 to YLn are connected to an output terminal of the Y driver 153 in common, and the row electrodes YR1 to YRn are connected to an output terminal of the Y driver 154 in common. The Y drivers 153 and 154 are also referred to as "left-side Y driver 153" and "right-side Y driver 154" respectively.

The control circuit 40 generates the control signals based on an input video signal S and outputs the same to the driving circuits 16, 17, 18, 153 and 154.

B. Method of Driving AC-PDP 61

B-1. Principle of Driving

First, the principle of control of discharge in the discharge cells of the AC-PDP 61 is described.

Row electrodes (corresponding to "strip portions" of a sustain electrode respectively, and the generic term therefor corresponds to "sustain electrode") YLi1 and YRi2 belong to arbitrary two discharge cells belonging to column electrodes (corresponding to "strip portions" of an address electrode respectively, and the generic term therefor corresponds to "address electrode") Wj and Wm+1−j connected to the driving IC 182 in common and supplied with the same voltage, such as discharge cells of matrices (i1, j) and (i2 (≠i1), m+1−j), for example.

Each of the row electrodes X1 to Xn can be grasped as a strip portion of a scan electrode assuming that the generic term for the n row electrodes X1 to Xn is "scan electrode". Discharge can be formed in the discharge cells of the aforementioned matrices (i1, j) and (i2, m+1−j) independently of each other by controlling the potential difference between the row electrodes Xi1 and YLi1 and that between the row electrodes Xi2 and YRi2 also when the same voltage is applied to the column electrodes Wj and Wm+1−j (address electrode). Also when a plurality of discharge cells belong to the column electrode Wj or/and the column electrode Wm+1−j, the plurality of discharge cells can be independently controlled by controlling the potential difference between row electrodes (or between strip portions of the sustain electrode and the scan electrode) belonging to the respective discharge cells.

When grasping the right and left halves of a single row electrode (strip electrode) Xi as strip portions respectively, this single row electrode (strip electrode) Xi can be referred to as "scan electrode". In this case, two discharge cells (given by matrices (i,j) and (i,m+1−j)) defined by this row electrode Xi and the column electrodes Wj and Wm+1−j can be independently controlled by controlling the voltage applied to the row electrodes YLi and YRi also when applying a voltage to the row electrode Xi (i.e., when applying a common voltage to respective strip portions of a single scan electrode). Therefore, the following driving method is applicable to this AC-PDP 61.

B-2. Driving Method According to Embodiment 1

Figure 2:
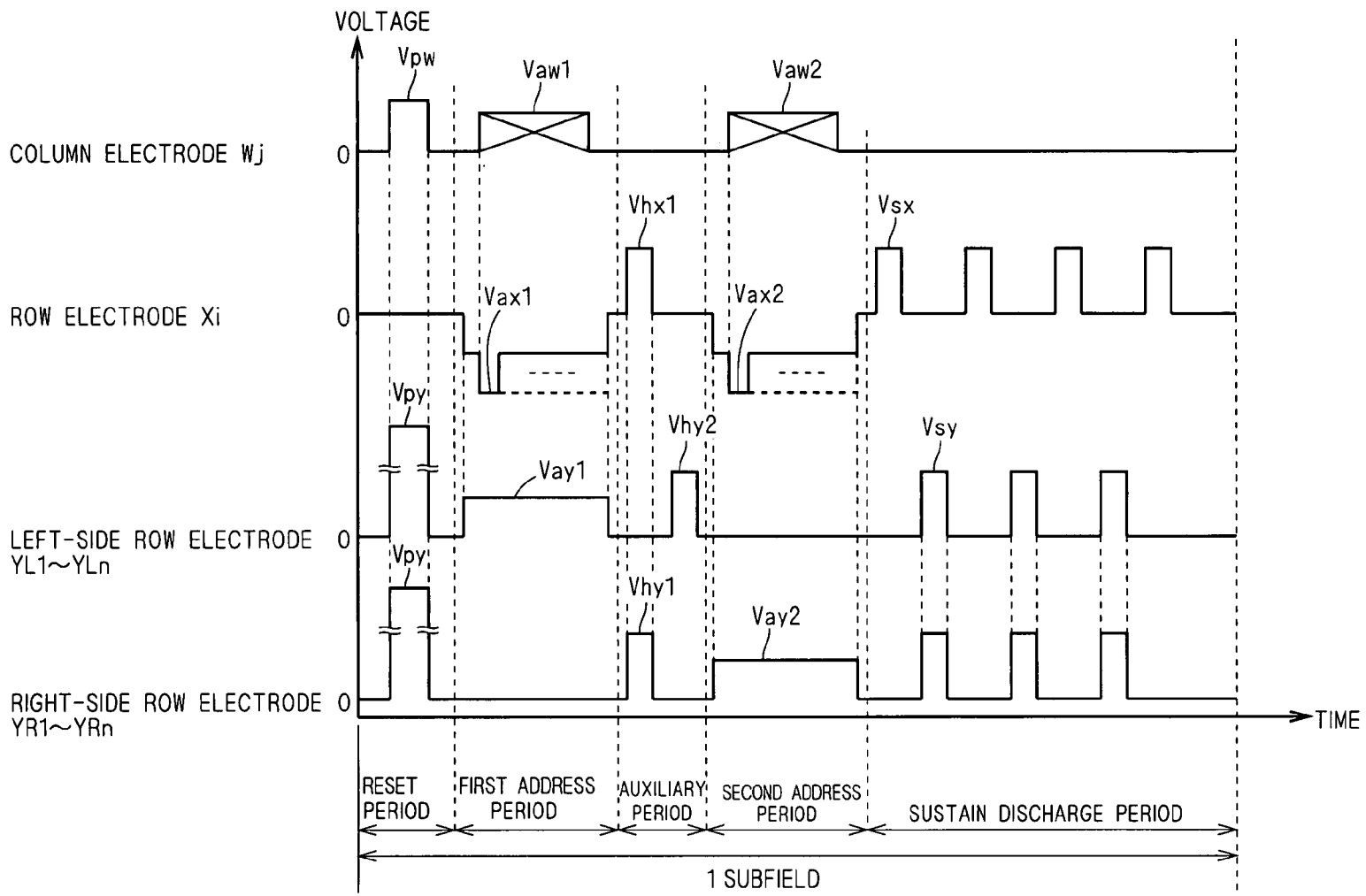
FIG. 2 is a timing chart showing a method of driving an AC plasma display panel according to the embodiment 1.

A specific method of driving the AC-PDP 61 in the plasma display device 60 is described with reference to a timing chart of driving voltages shown in FIG. 2. FIG. 2 shows waveforms of driving voltages applied to the column electrode Wj, the row electrode Xi, the left-side row electrodes YL1 to YLn and the right-side row electrodes YR1 to YRn in a single subfield (SF) respectively. The pulse waveforms shown in FIG. 2 are mere examples, and pulses entirely reversed in polarity to the voltage pulses shown in FIG. 2 may alternatively be employed.

In the driving method shown in FIG. 2, the single subfield is divided into five periods, i.e. "reset period", "first address period", "auxiliary period", "second address period" and "sustain discharge period (or sustain period)". In particular, this driving method is characterized in the driving method in the first and second address periods and the auxiliary period, and the conventional driving method shown in FIG. 13, for example, is applicable to the reset period and the sustain discharge period. These five periods are now described in detail.

B-2-1. Reset Period

In the reset period, a full writing pulse Vpy (voltage Vpy) is supplied to the row electrodes YL1 to YLn and the row electrodes YR1 to YRn, similarly to the conventional driving method. Thus, a display history at the end of a precedent subfield is erased while supplying priming particles for increasing a discharge probability in the subsequent first and second address periods. A voltage pulse Vpw (voltage Vpw) is applied to all column electrodes W1 to Wm at the same timing as the voltage pulse Vpy. This voltage pulse Vpw, applied not to cause discharge between the column electrodes W1 and Wm and the row electrodes YL1 to YLn and YR1 to YRn due to application of the voltage pulse Vpy, is preferably set to about an intermediate potential of the voltage pulse Vpy. For example, the voltage Vpy is set to 330 V and the voltage Vpw is set to 100 V.

B-2-2. First Address Period

In the first address period, address discharges (consisting of writing discharges and writing sustain discharges, as hereinabove described) is selectively caused in discharge cells to be displayed/lighted in the subsequent sustain discharge period among those belonging to the left-side row electrodes YL1 to YLn. In more detail, a scan pulse Vax1 (voltage Vax1) is successively applied from the row electrode X1 to the row electrode Xn similarly to the conventional driving method, while applying a voltage pulse Vaw1 (voltage Vaw1) to the column electrodes W1 to Wm on the basis of image data (corresponding to the input video signal S) in synchronization with the application of the pulse Vax1. For example, the voltage Vax1 is set to (−180) V, and the voltage Vaw1 is set to 40 V. In the following description, both of (i) an operation of forming address discharge in the discharge cell to be displayed/lighted in the subsequent sustain discharge period and (ii) an operation of forming no address discharge in the discharge cell not displayed/lighted in the period are generically referred to as "address operation" or "writing operation" as operations based on the input image data in the (first and second) address periods.

According to this driving method, a voltage pulse (first voltage) Vay1 (voltage Vay1) which is a subscan pulse is applied to all left-side row electrodes YL1 to YLn while all right-side row electrodes YR1 to YRn are set to a ground potential (or GND potential) (second voltage) in a period for scanning the row electrodes X1 to Xn (therefore, the potential difference (first potential difference) between the row electrodes Xi and YLi is greater than the potential difference (second potential difference) between the row electrodes Xi and YRi). The reason for this is as follows: An applied voltage to the electrodes Xi and Wj necessary for causing "writing discharge" between the row electrodes Xi and Wj remarkably depends on the potential applied to the row electrodes YLi and YRi. When the maximum potential difference is supplied to the pair of row electrodes Xi and YLi (or YRi) within the range causing no discharge between the pair of electrodes Xi and YLi (or YRi), for example, writing discharge can be formed also when the potential across the electrodes Xi and Wj is small. On the other hand, the voltage applied across the electrodes Xi and Wj for generating writing discharge must be increased as the potential difference between the pair of row electrodes Xi and YLi (or YRi) is reduced. In the first address period, therefore, the address operation is executed on the discharge cells belonging to the left-side row electrodes YL1 to YLn while generating no writing discharge in all discharge cells belonging to the right-side row electrodes YR1 to YRn by voltage control of the aforementioned subscan pulse Vay1. At this time, the voltage Vay1 is set to 60 V, for example.

Following the writing discharge between the electrodes Xi and Wj, "writing sustain discharge" is generated between the row electrode Xi and the left-side row electrode YLi triggered by the writing discharge. Such transition from the writing discharge to the writing sustain discharge also depends on the potential difference between the pair of electrodes Xi and YLi. When the subscan pulse Vay1 applied to the left-side row electrode YLi is 60 V, the potential difference between the pair of electrodes Xi and YLi is 240 V (=60 V−(−180 V)) and hence the aforementioned transition of discharge can be sufficiently caused. On the other hand, the right-side row electrode YRi is at the ground potential and hence no discharge transition takes place in the pair of electrodes Xi and YRi supplied with the potential difference of 180 V.

Even if writing discharge takes place in discharge cells belonging to the right-side row electrode YRi, therefore, no transition to writing sustain discharge between the electrodes Xi and YRi takes place.

In a discharge cell causing address discharge, minus wall charges are stored on the dielectric substance covering the row electrode YLi (hereinafter simply expressed as "above the row electrode Yi") while plus wall charges are stored above the row electrode Xi, and minus wall charges are stored above the column electrode Wj. However, discharge employing (the voltage applied to) the column electrode Wj is writing discharge for triggering writing sustain discharge and smaller than the mainly writing sustain discharge between the electrodes Xi and YLi, and hence the quantity of the wall charges above the column electrode Wj is relatively small.

When setting the potentials of the right-side row electrodes YR1 to YRn to the voltage Vax1 (at this time, the voltage Vax1 corresponds to the second voltage and the potential difference (second potential difference) between the row electrodes Xi and YRi is zero) in the first address period, occurrence of discharge in the discharge cells belonging to the row electrodes YR1 to YRn can be further reliably prevented.

In this first address period, an address operation of discharge cells belonging to pairs of even electrodes Xi and YLi for thereafter performing an address operation of discharge cells belonging to pairs of odd row electrodes Xi and Yi. This also applies to the second address period described later.

B-2-3. Auxiliary Period

It is preferable that absolutely no address discharge (writing discharge and writing sustain discharge) takes place in the discharge cells belonging to the right-side row electrodes YR1 to YRn. However, writing discharge which is initial discharge of address discharge may be caused between the electrodes Xi and Wj. When discharge is generated between the electrodes Xi and Wj, small quantities of plus wall charges and minus wall charges are formed above the row electrode Xi and above the column electrode Wj respectively, as described above. When entering the second address period for the discharge cells belonging to the right-side row electrodes YR1 to YRn in such charge states, it may be impossible to perform a normal address operation. In other words, such a situation (the so-called no lighting) that desired luminous cells are not lighted in the sustain discharge period when no address discharge is caused in the discharge cells to form address discharge. When (false) discharge is caused in discharge cells requiring no formation of address discharge, unnecessary lighting takes place in the sustain discharge period (the so-called false lighting). Further, the aforementioned wall charges above the electrodes Xi and Wj narrow the voltage margin of each voltage pulse in the second address period.

Before entering the second address period, therefore, (a) the wall charge states of the discharge cells belonging to the left-side row electrodes YLi ending the address operation in the first address period are not changed but (b) the wall charges of discharge cells causing discharge in the first address period among those belonging to the right-side row electrodes YRi are reduced at least to a degree capable of avoiding the aforementioned non-lighting or the like in this auxiliary period.

As shown in FIG. 2, in an initial stage of the auxiliary period, voltage pulses Vhx1 (voltage Vhx1) and Vhy1 (voltage Vhy1) are applied to all row electrodes X1 to Xn and right-side row electrodes YR1 to YRn respectively at the same timing while setting the left-side row electrodes YL1 to YLn and the column electrodes W1 to Wm to the ground potential. At this time, the voltages Vhx1 and Vhy1 are set to the same level (e.g., 180 V). According to such voltage setting, the row electrode Xi and the right-side row electrode YRi are at the same potential and hence discharge (first auxiliary discharge) takes place between the electrodes Xi and Wj and between the electrodes YRi and Wj in the discharge cells belonging to the right-side row electrode YRi. The aforementioned wall charges above the electrodes Xi and Wj can be reduced by such discharge.

On the other hand, the aforementioned voltage Vhx1 is applied to the row electrode Xi while the left-side row electrode YLi is at the ground potential, and hence the applied voltage is superposed on the wall charges in the discharge cells having the wall charges generated by address discharges in the first address period among the discharge cells belonging to the left-side row electrode YLi to cause discharge (second auxiliary discharge) between the electrodes Xi and YLi. Due to the discharge between the electrodes Xi and YLi, the polarity of the wall charges of the discharge cells above the electrodes Xi and YLi is reversed with respect to that upon termination of the first address period.

A voltage pulse Vhy2 (voltage Vhy2) is applied to the left-side row electrodes YL1 to YLn while the row electrodes X1 to Xn, the right-side row electrodes YR1 to YRn and the column electrodes W1 to Wm are set to the ground potential at the subsequent timing. For example, the voltage Vhy2 is set to 180 V. Due to such voltage application, discharge (second auxiliary discharge) is caused in the discharge cells having the wall charges (reversed with respect to the polarity upon termination of the first address period as described above) among the discharge cells belonging to the left-side row electrodes YL1 to YLn. The aforementioned first auxiliary discharge in the discharge cells can be grasped as second auxiliary discharge, and hence it can be said that second auxiliary discharge is formed twice in the discharge cells. As a result (of forming the second auxiliary discharge twice), the wall charge state (or potential relation resulting from the wall charges) of the discharge cell returns to the state upon termination of the first address period.

On the other hand, the right-side row electrodes YR1 to YRn, the row electrodes X1 to Xn and the column electrodes W1 to Wm are at the ground potential and hence no discharge occurs in the discharge cells belonging to the right-side row electrodes YR1 to YRn.

Thus, (a) without changing the wall charge states of the discharge cells belonging to the left-side row electrodes YLi, (b) the quantities of the wall charges in the discharge cells belonging to the right-side row electrodes YRi can be reduced after the auxiliary period. Thus, a normal address operation can be executed in the subsequent second address period, while the voltage margin of each voltage pulse in the second address period can be spread to a degree causing discharge between the electrodes Xi and Wj.

According to the driving in the auxiliary period, the charge states of the discharge cells belonging to the left-side row electrodes YL1 to YLn are more stabilized. The reason for this is as follows: In general, discharge between electrodes and states of wall charges are further stabilized by repetitively executing the discharge. At this time, the wall charges are gradually amplified to reach a stationary state (stationary quantity) due to the repetitive discharge. In the discharge cells belonging to the left-side row electrodes YL1 to YLn formed with the wall charges in the first address period, therefore, the discharge (second auxiliary discharge) between the pairs of row electrodes Xi and YLi is formed by the voltage pulses Vhx1 and Vhy2 in the auxiliary period and hence the wall charges are grown and stabilized as compared with the case of forming discharge only once in the first address period. Consequently, sustain discharge in the sustain discharge period can be more reliably started according to this driving method. In particular, this driving method has the auxiliary period and the second address period between the first address period and the sustain discharge period, whereby the aforementioned wall charge stabilizing effect is extremely effective. This is because the wall charges may disappear due to induction of unexpected discharge to cause a non-lighted state in the sustain discharge period when the voltage pulses are applied to the row electrodes X1 to Xn or the column electrodes W1 to Wm in the auxiliary period or the second address period in an unstable state of the wall charges.

B-2-4. Second Address Period

Driving in the second address period is executed subsequently to the auxiliary period. In the second address period, the aforementioned address operation in the first address period is performed on the discharge cells belonging to the right-side row electrodes YR1 to YRn. Therefore, a scan pulse Vax2 (voltage Vax2) equivalent to the aforementioned voltage pulse Vax1 is applied to the row electrodes X1 to Xn, and a voltage pulse Vaw2 (voltage Vaw2) equivalent to the aforementioned voltage pulse Vaw1 is applied to the column electrodes W1 to Wm in synchronization with the pulse Vax similarly to the first address period. Particularly in the second address period, a voltage pulse (first voltage) Vay2 (voltage Vay2) equivalent to the aforementioned voltage pulse Vay1 is applied to the right-side row electrodes YR1 to YRn while the left-side row electrodes YL1 to YLn are set to the ground potential (second voltage) (therefore, the potential difference (first potential difference) between the row electrodes Xi and YRi is greater than the potential difference (second potential difference) between the row electrodes Xi and YLi). At this time, the voltages Vaw2, Vax2 and Vay2 are set to the voltages Vaw1, Vax1 and Vay1 respectively, for example.

Due to such driving, the address operation can be executed on the discharge cells belonging to the right-side row electrodes YR1 to YRn without causing discharge in the discharge cells belonging to the left-side row electrodes YL1 to YLn.

When setting the potentials of the left-side row electrodes YL1 to YLn to the voltage Vax2 (at this time, the voltage Vax2 corresponds to the second voltage and the potential difference (second potential difference) between the row electrodes Xi and YLi is zero) in the second address period similarly to the first address period, occurrence of discharge in the discharge cells belonging the row electrodes YL1 to YLn can be more reliably prevented.

B-2-5. Sustain Discharge Period

After the address operations on all discharge cells in the first and second address periods, driving in the sustain discharge period is performed. More specifically, sustain pulses Vsx (voltage Vsx) and Vsy (voltage Vsy) are alternately applied to all row electrodes X1 to Xn and all row electrodes YL1 to YLn and YR1 to YRn by a prescribed count defined for each subfield, as shown in FIG. 2. Due to such voltage application, sustain discharges of this subfield are generated in the discharge cells generating address discharges. When setting the voltages Vsx and Vsy to 180 V identically to the aforementioned voltages Vhx1, Vhy1 and Vhy2, the power supply circuit 41 or the plasma display device 60 shown in FIG. 1 can advantageously be formed with a small number of power sources.

In the method of driving the AC-PDP 61 (or the plasma display device 60) according to the embodiment 1, as hereinabove described, common voltages are applied to the pairs of electrodes among the m column electrodes W1 to Wm provided on the AC-PDP 61, whereby the number of the column electrode driving ICs 182 can be halved as compared with the conventional plasma display device. Therefore, the cost for the plasma display device 60 can be remarkably reduced as compared with the conventional plasma display device.

The plasma display device 60 comprises two Y drivers 153 and 154 as shown in FIG. 1, and the number of the drivers is greater than that in the conventional plasma display device. Considering that (i) the unit price for the driving ICs 162, 172 and 182 for the respective electrodes is higher than that for the drivers 153, 154, 161, 171 and 181 and (ii) the effect of reducing the cost by reducing the number of the output terminals of driving ICs for the column electrode is remarkably larger than the cost increase caused by increasing the number of output terminals of the Y drivers when grasping the cost for the driving ICs or the like as the cost per output terminal, however, it can be said that the effect of reducing the cost by the plasma display device 60 is remarkable.

The driving circuits 16 and 17 for the row electrodes X1 to Xn may be arranged on one portion, e.g., on the left side of the AC-PDP 61. When intensively arranging the driving circuits 16 and 17 for the row electrodes X1 to Xn on one portion, e.g., on the left side of the AC-PDP 61, however, the packaging density of the set space on the left side of the AC-PDP 61 is inevitably increased. In the plasma display device 60, therefore, the driving circuits for the row electrodes X1 to Xn are divided and arranged on the right and left of the AC-PDP 61, as shown in FIG. 1.

In this case, the left ends of the odd ones of the row electrodes X1 to Xn are connected to the output terminal of the driving circuit 16 and the right ends of the even electrodes are connected to the output terminal of the driving circuit 17, whereby luminance unevenness of a displayed image resulting from subtle difference between circuit impedances of the circuits 16 and 17 can be suppressed as a whole. Further, it is possible to minimize wiring impedances and uniformalize the wiring impedances by arranging the driving circuits 16 and 17 and the Y drivers 153 and 154 approximately to the electrodes to be connected therewith.

Therefore, the plasma display device 60 attains an effect of superior visuality to a plasma display device having driving circuits 16, 17, 153 and 154 intensively arranged on one portion. In view of the circuit set space and visuality, it can be said that the arrangement of the elements of the plasma display device 60 shown in FIG. 1 is preferable.

The row electrodes X1 to Xn in the AC-PDP 61 may be vertically divided (grouped) into two sections to be driven.

Embodiment 2

Figure 3:
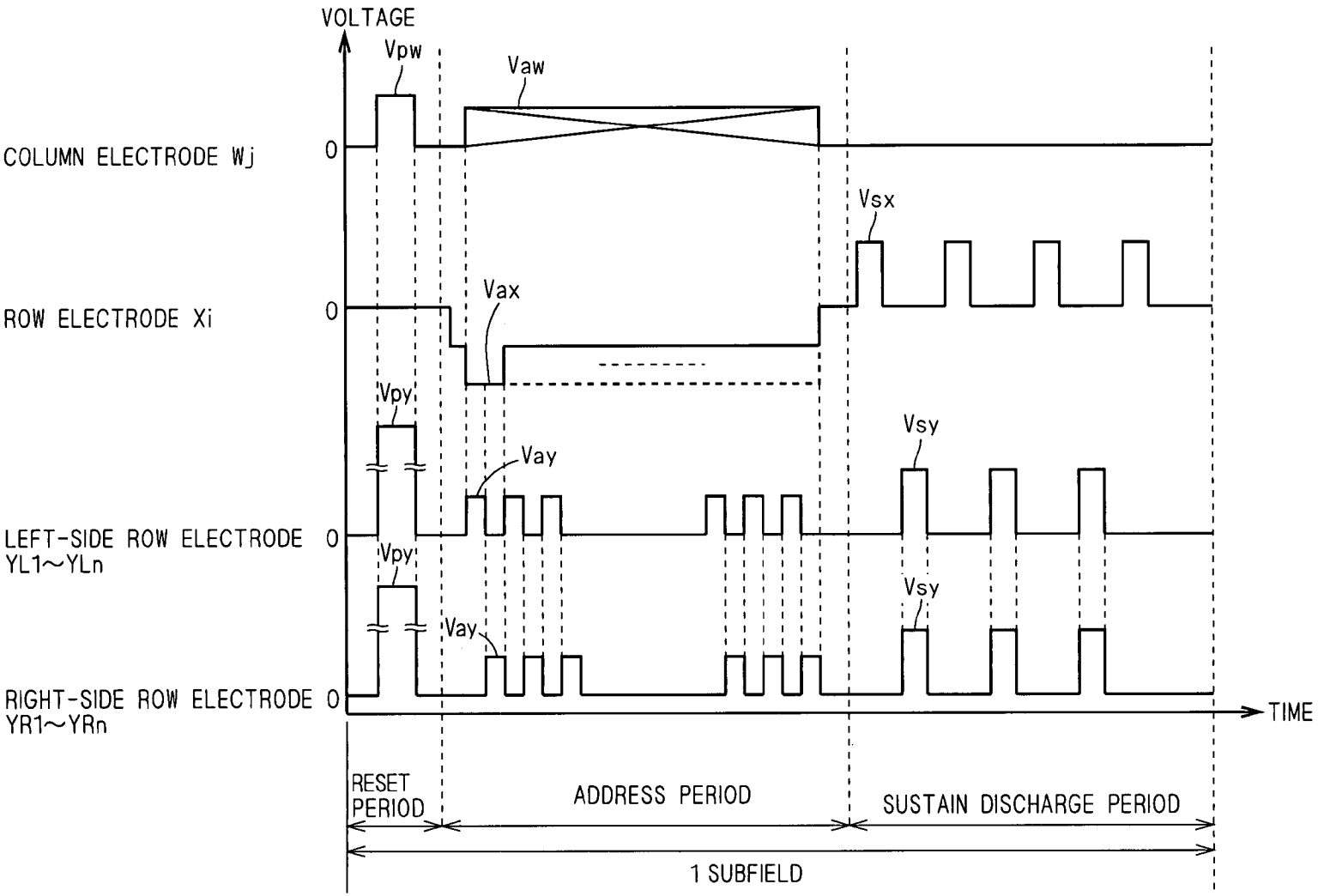
FIG. 3 is a timing chart showing a method of driving an AC plasma display panel according to an embodiment 2 of the present invention.

Another driving method applicable to the AC-PDP 61 is now described with reference to a timing chart of FIG. 3. FIG. 3 shows voltages similar to those in FIG. 2. Pulses entirely reversed in polarity to the voltage pulses shown in FIG. 3 may be employed. The plasma display device 60 shown in FIG. 1 can implement this driving method.

In the driving method according to an embodiment 2 of the present invention, one subfield is divided into three periods, i.e., "reset period", "address period" and "sustain discharge period", as shown in FIG. 3. In particular, the driving method in the address period characterizing this embodiment is mainly described. The aforementioned driving method according to the embodiment 1 (or the conventional driving method shown in FIG. 13, for example) is applicable to the reset period and the sustain discharge period, and hence redundant description is omitted.

As shown in FIG. 3, a scan pulse Vax (voltage Vax) is successively applied to the row electrodes X1 to Xn in the address period according to this driving method. At this time, a voltage pulse (or first voltage) Vay (voltage Vay) is applied to the left-side row electrodes YL1 to YLn, the right-side row electrodes YR1 to YRn are set to the ground potential (or second voltage) and a voltage pulse Vaw (voltage Vaw) based on the image data of the discharge cell of the matrix (i,j) is applied to the column electrode Wj (and Wm+1−j) in synchronization with the voltage pulse Vay in the first half of the period for applying the scan pulse Vax to the row electrode Xi. For example, the voltages Vax, Vay and Vaw are set to (−180) V, 60 V and 40 V respectively. The voltage pulse Vay, corresponding to the voltage pulses Vay1 and Vay2 (see FIG. 1) in the driving method according to the embodiment 1, is employed for ensuring control as to whether or not to execute an address operation.

Then, the voltages for the left-side row electrodes YLi and the right-side row electrodes YR1 to YRn are exchanged in the second half of the scan pulse Vax. In other words, the left-side row electrodes YL1 to YLn are set to the ground potential (or second voltage), the voltage pulse (or first voltage) Vay is applied to the right-side row electrodes YR1 to YRn and the voltage pulse Vaw based on the image data of the discharge cell of the matrix (i,m+1−j) is applied to the column electrode Wm+1−j (and Wj) in synchronization with the voltage pulse Vay.

Thus, in the address period according to the embodiment 2, the period for applying the scan pulse Vax is divided into two periods for executing an address operation on the discharge cells belonging to the left-side row electrodes YL 1 to YLn in one of the two periods and executing an address operation on the discharge cells belonging to the right-side row electrodes YR1 to YRn in the other period. According to this driving method, an effect of reducing the number of column electrode driving ICs 182 can be attained similarly to the driving method according to the embodiment 1.

Embodiment 3

An embodiment 3 of the present invention is described with reference to another AC-PDP 71 to which the aforementioned driving methods according to the embodiments 1 and 2 are applicable.

Figure 4:
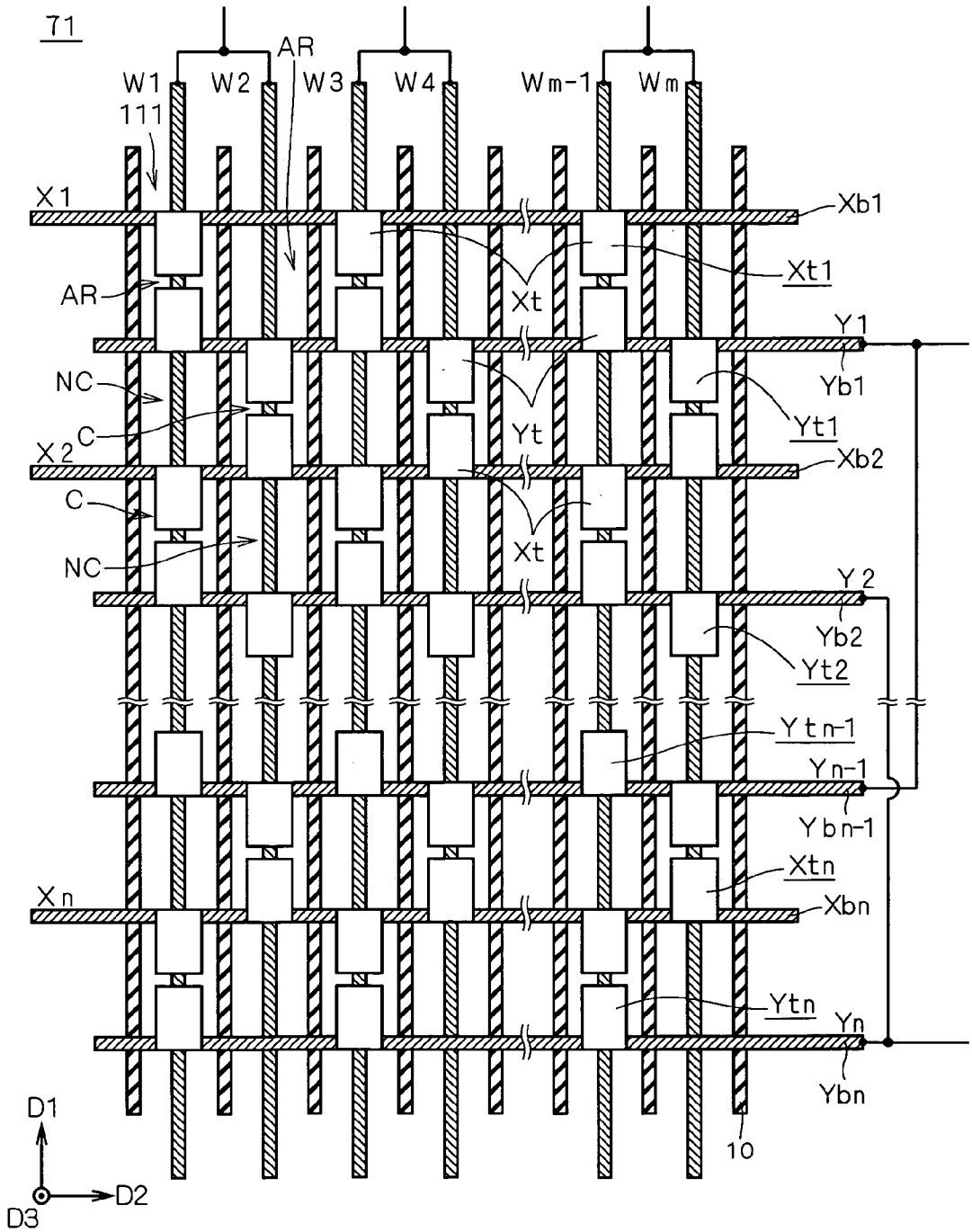
FIG. 4 is a plan view for illustrating the structure of an AC plasma display panel according to an embodiment 3 of the present invention.
Figure 5:
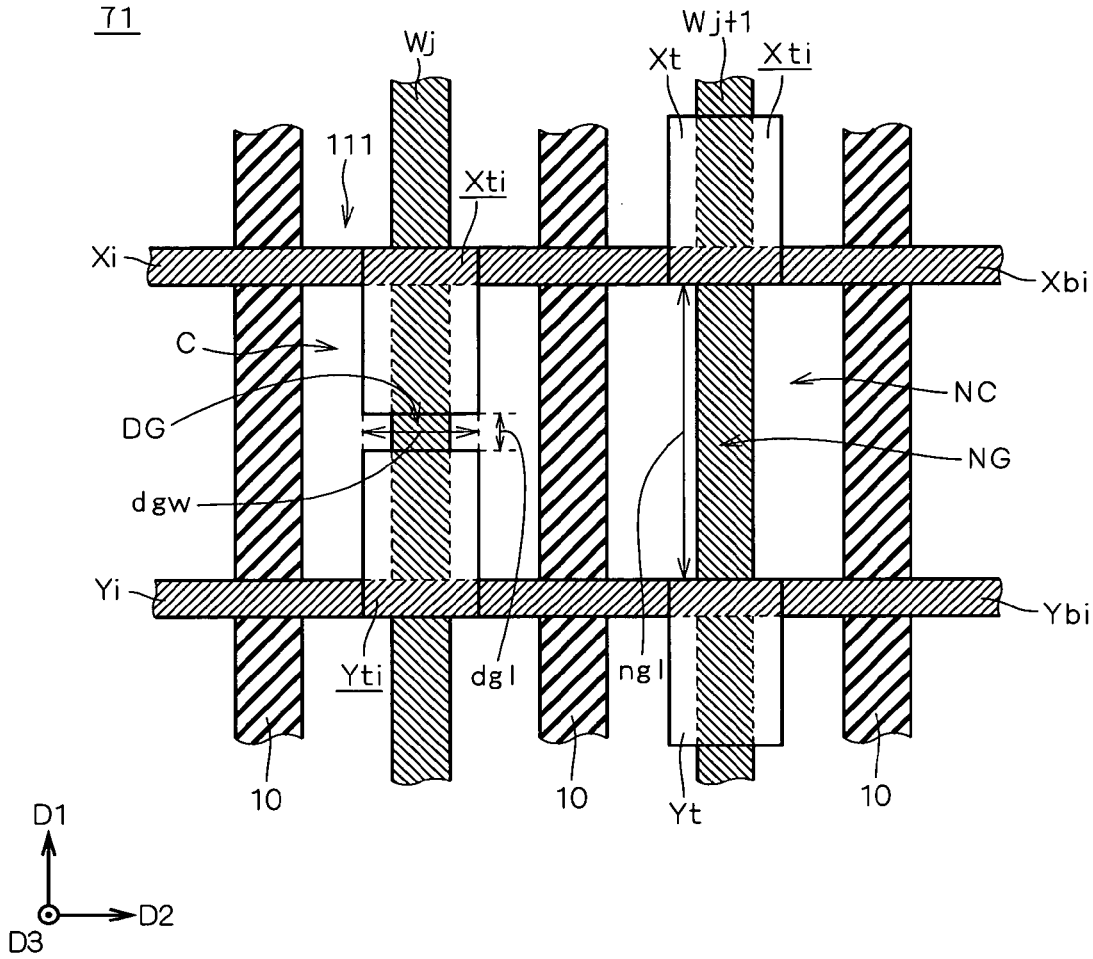
FIG. 5 is a plan view showing a principal part of the structure of the AC plasma display panel according to the embodiment 3.
Figure 11:
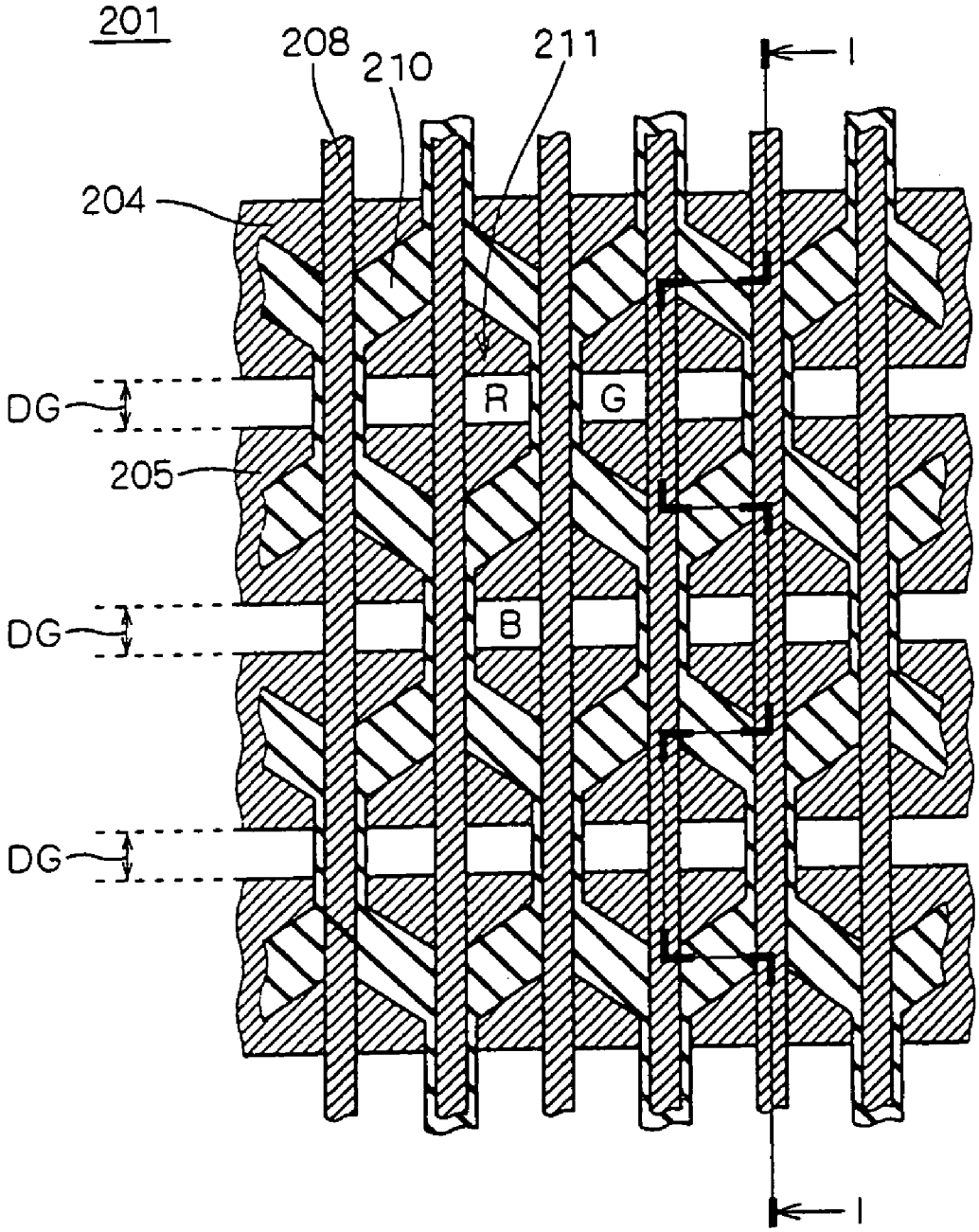
FIG. 11 PRIOR ART
FIG. 11 is a plan view showing the structure of an AC plasma display panel according to second background art.
Figure 12:
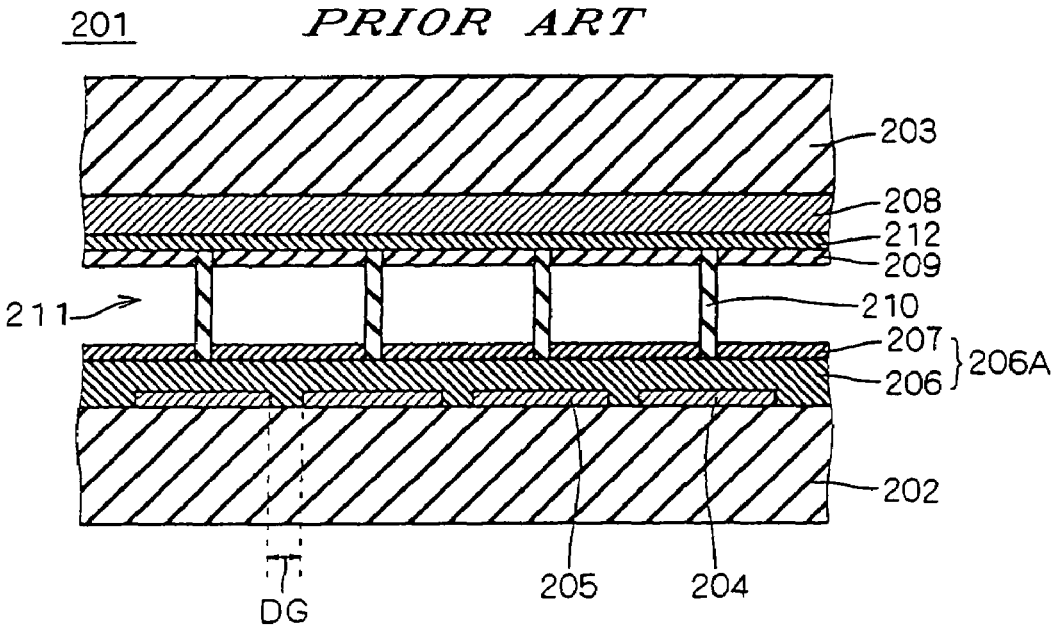
FIG. 12 PRIOR ART
FIG. 12 is a longitudinal sectional view showing the structure of the AC plasma display panel according to the second background art.

FIG. 4 is a plan view typically showing the structure of the AC-PDP 71 according to the embodiment 3, and FIG. 5 is an enlarged view of a principal part shown in FIG. 4. The AC-PDP 71 is described with reference to the structures of electrodes and barrier ribs (also referred to as "ribs") characterizing the same, and FIGS. 4 and 5 extract and illustrate only the electrodes and the barrier ribs of the AC-PDP 71. As to the remaining elements of the AC-PDP 71, those equivalent to the elements of the conventional AC-PDP are applicable. Therefore, elements equivalent to those of the aforementioned AC-PDPs 101 and 201 (see FIGS. 10 to 12) are denoted by the same reference numerals, to omit redundant description.

As shown in FIGS. 4 and 5, n row electrodes X1 to Xn (an arbitrary one of the n row electrodes X1 to Xn is referred to as "row electrode Xi" (i=1 to n)) and n row electrodes Y1 to Yn (an arbitrary one of the n row electrodes Y1 to Yn is referred to as "row electrode Yi" (i=1 to n)) are alternately arranged on the side of a front glass substrate 102 (see FIG. 10) forming a display surface. On the other hand, m column electrodes W1 to Wm (an arbitrary one of the m column electrodes W1 to Wm is referred to as "row electrode Wj" (j=1 to m)) are arranged on the side of a rear glass substrate 103 (see FIG. 10) in a direction grade-separately intersecting with the row electrodes Xi and Yi. The front glass substrate 102 and the rear glass substrate 103 are opposed to each other in parallel at a prescribed distance. In this case, barrier ribs 10 arranged to separate two adjacent column electrodes Wj and Wj+1 from each other divide the space between the substrates 102 and 103 into a plurality of discharge spaces 111.

In more detail, the column electrodes W1 to Wm (corresponding to the column electrodes 108 shown in FIG. 10) extending along a first direction D1 parallel to the surface of the rear glass substrate 103 closer to the discharge spaces 111 are arranged at regular pitches in a second direction D2 perpendicular to the first direction D1 in this surface, similarly to the AC-PDP 101. It is assumed that the first and second directions D1 and D2 are vertical and transverse directions on a display screen of the AC-PDP 71 respectively. The barrier ribs 10 are arranged in the form of stripes along the first direction D1, similarly to the barrier ribs 110 shown in FIG. 10. Phosphor layers 109R, 109G and 109B for respective luminous colors are arranged in U-shaped trenches defined by the aforementioned surface of the rear glass substrate 103 and opposed side wall surfaces of adjacent barrier ribs 10 in units of the U-shaped trenches. A dielectric layer may be provided on the aforementioned surface of the rear glass substrate 103 to cover the column electrodes W1 to Wm, for arranging the barrier ribs 10 and the phosphor layers 109 on the dielectric layer.

On the front glass substrate 102, on the other hand, the row electrodes Xi, Yi consist of strip-shaped bus electrodes Xbi and Ybi extending along the second direction D2 on the surface of the substrate 102 closer to the discharge spaces 111 and m transparent electrodes Xt and Yt (the relation with the bus electrodes Xbi and Ybi is clarified as "transparent electrodes Xti and Yti" with subscripts i when particularly necessary) of square shapes, for example, having ends connected to prescribed positions (described later) of the bus electrodes Xbi and Ybi respectively. In this case, n bus electrodes Xb1 to Xbn and n bus electrodes Yb1 to Ybn are alternately arranged in parallel with each other at regular pitches in relation to the first direction D1. The bus electrodes Xbi and Ybi are preferably lower in impedance than the transparent electrodes Xt and Yt. While the transparent electrodes Xt and Yt are arranged on the surface of the front glass substrate 102 closer to the discharge spaces 111 and the bus electrodes Xbi an Ybi are arranged on the aforementioned surface to cover end portions of the transparent electrodes Xti and Yti in FIGS. 4 and 5, the order of these electrodes may be reversed.

Similarly to the AC-PDP 101, a dielectric layer 106 (or 106A) is arranged to cover the row electrodes X1 to Xn and the row electrodes Y1 to Yn. When at least either the row electrodes X1 to Xn or the row electrodes Y1 to Yn are covered with a dielectric substance, a memory function resulting from wall charges in the AC-PDP can be attained so that the aforementioned driving method separating the address period and the sustain period shown in FIG. 13 is applicable.

The transparent electrodes Xt and Yt are now described in detail. In the following description, respective ones of a plurality of areas defined as those divided by 2n bus electrodes Xb1 to Xbn and Ybi to Ybn and (m+1) barrier ribs 10 in the form of a matrix are referred to as "unit areas AR". In this case, the unit areas AR can also be grasped as defined by respective grade-separate intersections between the row electrodes X1 to Xn and Y1 to Yn (or gaps between adjacent two row electrodes) and the column electrodes W1 to Wm. However, the unit areas AR are not restricted to the two-dimensional areas shown in FIG. 4 but also stand for three-dimensional areas extending in a third direction D3 perpendicular to both of the first and second directions D1 and D2 in relation to the two-dimensional areas.

Each of the transparent electrodes Xti has an end connected to the bus electrode Xbi, and extends in one of two unit areas AR adjacent to each other in the first direction D1 through the bus electrode Xbi. Further, the m transparent electrodes Xt alternately extend in different directions in relation to the first direction D1. In other words, adjacent transparent electrodes Xt are formed not to extend in the same direction. Similarly, m transparent electrodes Yt forming the transparent electrodes Yti have ends connected to the bus electrodes Ybi, and alternately extend into the unit areas AR in different directions in relation to the first direction D1. In particular, extending edges of the transparent electrodes Xt and Yt are opposed to each other in the same unit area AR through a prescribed gap (corresponding to a discharge gap as described later) DG, as shown in FIG. 5. The space (or distance) between the opposed transparent electrodes Xt and Yt is referred to as "space (or distance) (of the gap DG) dg1", and the length of the opposed portions of the edges of the transparent electrodes Xt and Yt is referred to as "width (or length) dgw of the gap DG". On the other hand, the gap (corresponding to a non-discharge gap as described later) between opposed edges of two adjacent bus electrodes is referred to as "gap NG", and the space (or distance) between these edges is referred to as "space (or distance) ng1 (of the gap NG)".

Figure 6:
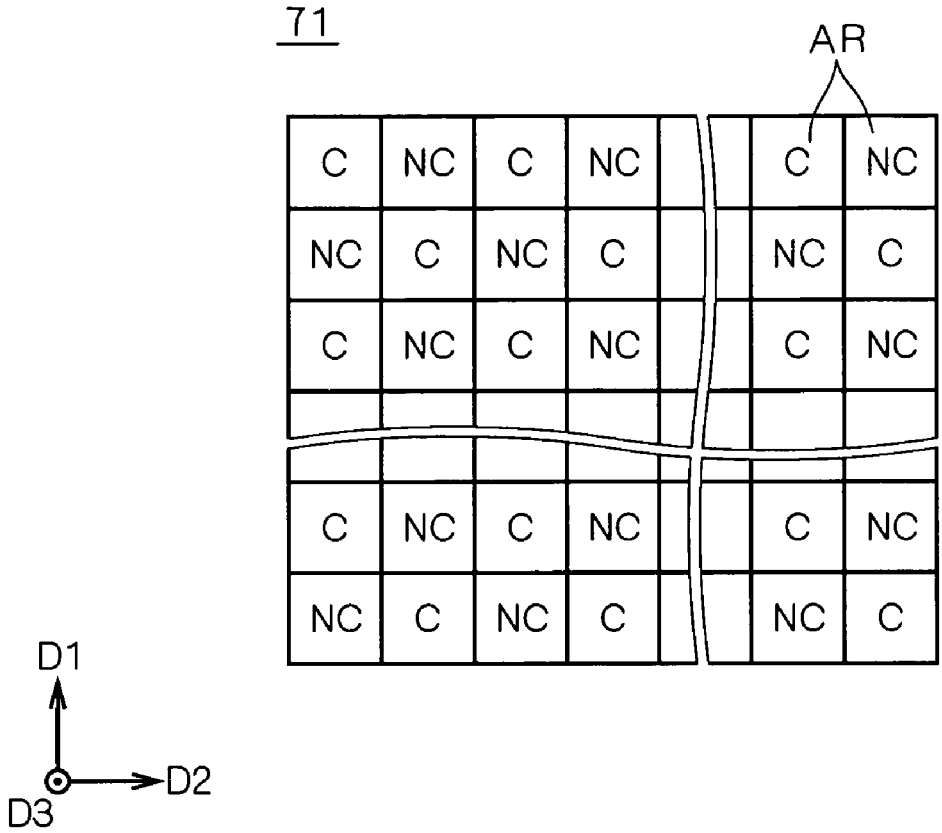
FIG. 6 is a plan view typically showing the arrangement of discharge cells and non-discharge cells in the AC plasma display panel according to the embodiment 3.
Figure 7:
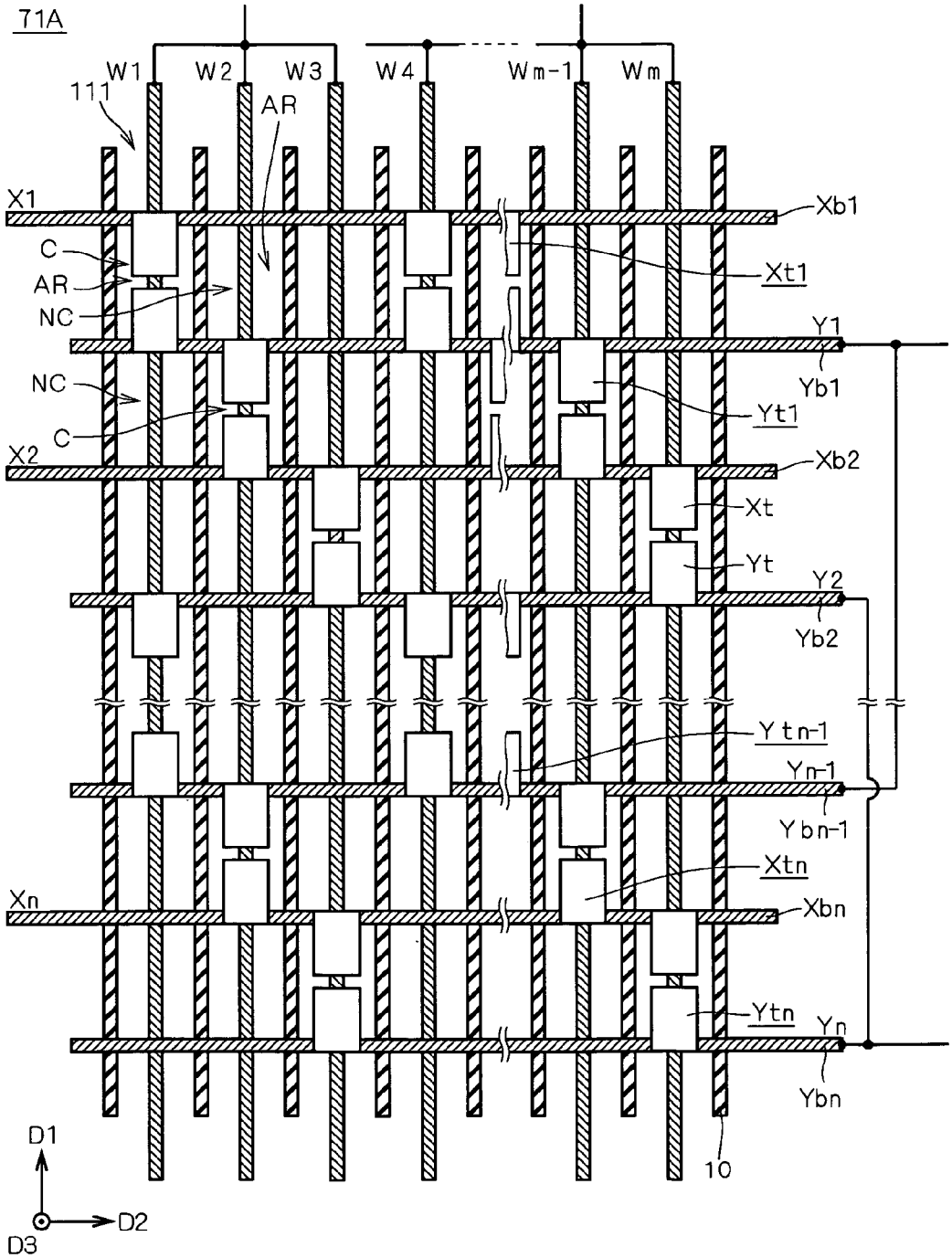
FIG. 7 is a plan view for illustrating another structure of the AC plasma display panel according to the embodiment 3.

The AC-PDP 71, comprising the aforementioned row electrodes X1 to Xn and Y1 to Yn, can generate discharge in the gaps DG without causing discharge in the gaps NG by controlling a voltage applied across adjacent row electrodes Xi and Yi (or Yi−1) due to the difference between the sizes of the spaces dg1 and ng1 of the gaps DG and NG. Therefore, the respective ones of the (three-dimensional) unit areas AR are divided into (i) "discharge cells (or discharge areas) C" which are unit areas AR having the gaps (hereinafter also referred to as "discharge gaps") DG formed by the transparent electrodes Xt and Yt and (ii) "non-discharge cells (or non-discharge areas) NC" which are unit areas having the gaps (hereinafter also referred to as "non-discharge gaps") NG formed by the bus electrodes Xbi and Ybi (or Ybi−1) without having the transparent electrodes Xt and Yt. In this case, the discharge cells C (or the discharge gaps DG of FIGS. 4 and 5) and the non-discharge gaps NC (or the non-discharge gaps NG of FIGS. 4 and 5) are alternately arranged in the directions parallel and perpendicular to display lines (or in the second and first directions D2 and D1) respectively so that the discharge cells C (or the discharge gaps DG) are not directly adjacent to each other in the aforementioned directions in the entire AC-PDP 71, as shown in FIG. 6. A plurality of non-discharge gaps NG may be adjacently arranged along the first and second directions D1 and D2. As an example of such a structure, FIG. 7 shows an AC-PDP 71A having adjacently arranged two non-discharge gaps NG. In the AC-PDP 71 (and an AC-PDP 72 shown in FIG. 9 described later), adjacent two of a plurality of gaps or spaces extending along two adjacent bus electrodes (or in the second direction D2) define "display line". In the AC-PDP 71A, adjacent three of gaps or spaces between the aforementioned adjacent pairs of bus electrodes define "display line". In the case of a single luminous color (in the case of having a single type of phosphor or having no phosphor), for example, a single aforementioned gap or space defines a display line.

Figure 8:
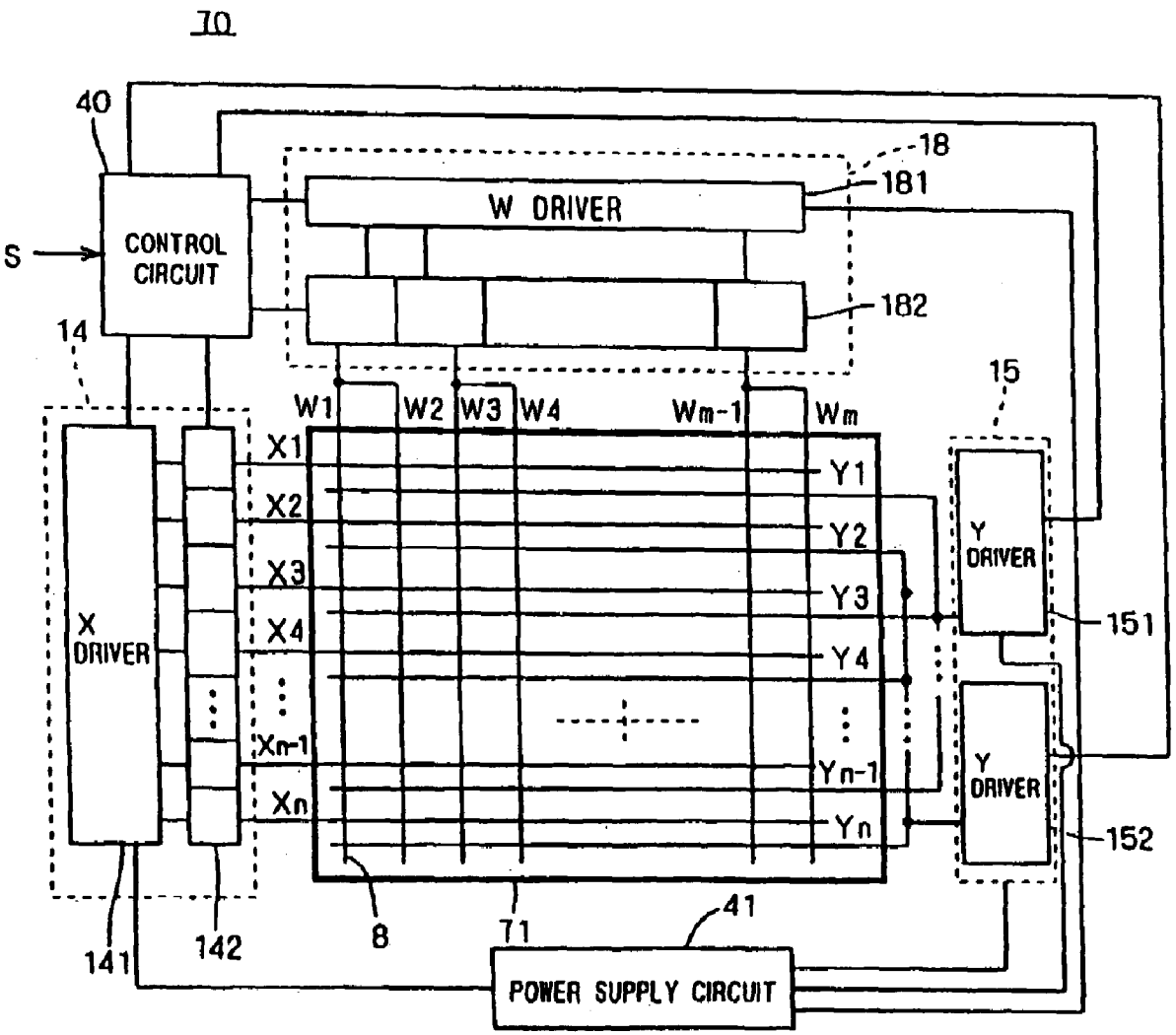
FIG. 8 is a block diagram showing the overall structure of a plasma display device according to the embodiment 3.

A plasma display device 70 comprising the AC-PDP 71 is now described with reference to FIG. 8. FIG. 8 is a block diagram typically showing the overall structure of the plasma display device 70 according to the embodiment 3. As shown in FIG. 8, the plasma display device 70 comprises the AC-PDP 71, driving circuits 14, 15 and 18 for supplying prescribed voltages to the row electrodes X1 to Xn and Y1 to Yn and the column electrodes W1 to Wm respectively, a control circuit 40 controlling the driving circuits 14, 15 and 18 and a power supply circuit 41 generating the prescribed voltages and supplying the same to the driving circuits 14, 15 and 18. A driving unit of the plasma display device 70 includes the driving circuits 14, 15 and 18.

First, the control circuit 40 generates control signals based on an input video signal S and outputs the same to the driving circuits 14, 15 and 18.

As shown in FIG. 8, the driving circuit 14 consists of an X driver 141 and driving ICs 142. The X driver 141 receives the control signal from the control circuit 40 and a supply voltage from the power supply circuit 41 and generates a prescribed voltage pulse. A plurality of output terminals of the driving ICs 142 are connected with corresponding ones of the row electrodes X1 to Xn respectively, and the driving ICs 142 scan and apply the prescribed voltage pulse generated in the X driver 141 on the basis of the control signal from the control circuit 40 to the row electrodes X1 to Xn respectively.

The driving circuit 15 consists of Y drivers 151 and 152 (generically referred to as "Y driver 15") each equivalent to the aforementioned X driver 141. Odd row electrodes Yi of the n row electrodes Y1 to Yn are connected to an output terminal of the Y driver 151 in common, and even row electrodes Yi are connected to an output terminal of the Y driver 152 in common. Thus, the same voltage is supplied to the odd and even ones of the row electrodes Y1 to Yn respectively.

The driving circuit 18 consists of a W driver 181 corresponding to the aforementioned X driver 141 and driving ICs 182 corresponding to the driving ICs 142. A pair of odd and even columns of the column electrodes W1 to Wm, such as two continuous column electrodes Wj and Wj+1 (j: odd number), for example, are connected to each of a plurality of output terminals of the driving ICs 182 in common, as shown in FIG. 8. When applying the aforementioned AC-PDP 71A (see FIG. 7) to the plasma display device 70, continuous three (column electrodes Wj, Wj+1 and Wj+2 (j: multiple of 3)) of the column electrodes W1 to Wm, for example, are connected to each of the output terminals of the driving ICs 182.

According to the plasma display device 70, the driving methods according to the aforementioned embodiments 1 and 2 can be applied. In the AC-PDP 71 or 71A, the generic term for two column electrodes (three column electrodes in the AC-PDP 71A) connected in common among the column electrodes W1 to Wm corresponds to "address electrode", and each of the two (or three) column electrodes corresponds to "strip portion". The generic term for all row electrodes X1 to Xn corresponds to "scan electrode" while the generic term for all row electrodes Y1 to Yn corresponds to "sustain electrode", and each of the row electrodes X1 to Xn and Y1 to Yn corresponds to a strip portion of each electrode.

Modification 1 of Embodiment 3

Figure 9:
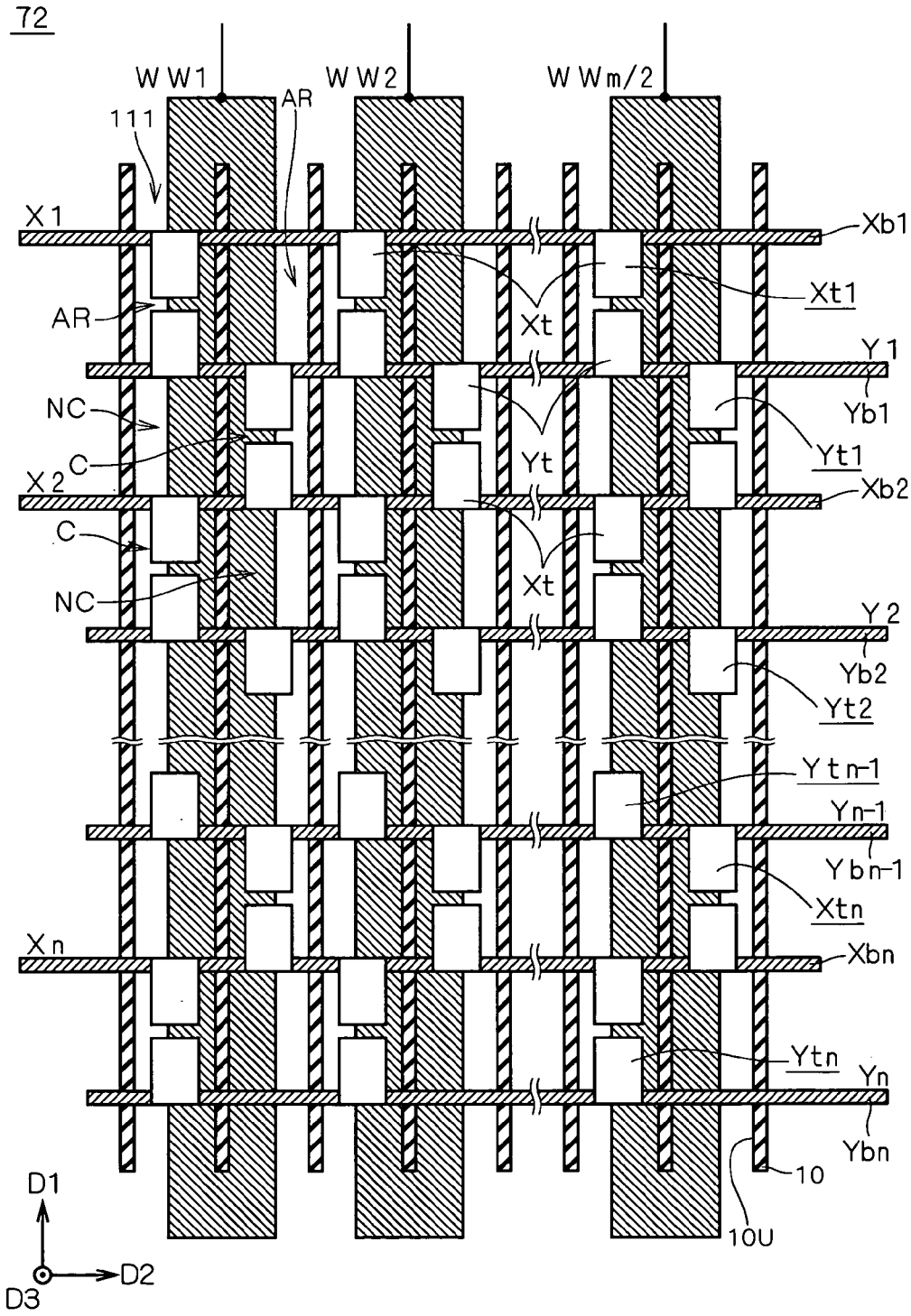
FIG. 9 is a plan view for illustrating the structure of an AC plasma display panel according to a modification 1 of the embodiment 3.

As means for applying the same voltage to the two adjacent column electrodes Wj and Wj+1 of the aforementioned AC-PDP 71, there are (a) means connecting (intermediate portions of) wires between respective input terminals of the AC-PDP 71 for the column electrodes and prescribed output terminals of the driving ICs 182 and (b) means integrating the terminal patterns of the aforementioned respective input terminals themselves. A modification 1 of the embodiment 3 is described with reference to an example of such means. FIG. 9 is a plan view (corresponding to FIG. 4) typically showing the structure of an AC-PDP 72 according to the modification 1 as viewed from the side of a display surface of this PDP. As shown in FIG. 9, the AC-PDP 72 is characterized in the structure of column electrodes WW1 to WWm/2, while remaining elements such as row electrodes X1 to Xn and Y1 to Yn and barrier ribs 10 are similar to those of the aforementioned AC-PDP 71 (see FIG. 4). Therefore, the modification 1 is described with reference to the column electrodes and the elements equivalent to those of the AC-PDP 71 are denoted by the same reference numerals, to omit redundant description.

As shown in FIG. 9, each of the m/2 column electrodes WW1 to WWm/2 provided on the AC-PDP 72 has such a shape/size that the two adjacent column electrodes (strip portions of the address electrode) Wj and Wj+1 (j: odd number) are integrated with each other in the AC-PDP 71 shown in FIG. 4. When grasping the plan view of FIG. 9 as a diagram projecting the elements of the AC-PDP 72 on a surface of a rear glass substrate 103 (see FIG. 10) closer to discharge spaces 111, each of the column electrodes WW1 to WWm/2 is formed on an area extending between a portion substantially around the center (axis) of one of two adjacent U-shaped trenches 10U along a first direction D1 and a portion around the center (axis) of another U-shaped trenches 10U.

The AC-PDP 72 can be driven by a driving method similar to that for the AC-PDP 71 by connecting each of the column electrodes WW1 to WWm/2 to a prescribed output terminal of driving ICs 182. Also when each of the column electrodes WW1 to WWm/2 is arranged over two discharge spaces 111 adjacent to each other through a barrier rib 10, the AC-PDP 72 can be driven without causing false discharge since discharge cells C and non-discharge cells NC are alternately arranged along the first and second directions D1 and D2 in the AC-PDP 72.

The AC-PDP 72 has a smaller number of column electrodes than the AC-PDP 71, whereby the cost for the AC-PDP can be reduced. Further, the width (size along a second direction D2) of the column electrodes is larger than that in the AC-PDP 71 for simplifying alignment in a column electrode forming step, whereby no high process accuracy is required in this step.

Other Modifications

The driving methods according to the aforementioned embodiments 1 and 2 are also applicable to the conventional AC-PDP 201 (see FIGS. 11 and 12), in addition to the AC-PDPs 61, 71 and 72. In other words, each of the aforementioned driving methods can drive an AC-PDP capable of controlling discharge in each of a plurality of discharge cells C supplied with a common voltage by a voltage (potential difference) independently supplied to each discharge cell C.

While the address electrode consists of two strip portions in each of the embodiments 1 to 3, it is obvious that each of the aforementioned driving methods is also applicable to an AC-PDP having an address electrode having a plurality of such strip portions.

While the invention has been shown and described in detail, the foregoing description is in all aspects illustrative and not restrictive. It is therefore understood that numerous modifications and variations can be devised without departing from the scope of the invention.

What is claimed is:

1. A method of driving an AC plasma display panel, wherein said AC plasma display panel comprises:

n (n is a positive integer) scan electrodes extending in one direction;

m (m is an even and positive integer of at least 2) address electrodes, each grade-separately intersecting with said n scan electrodes;

a plurality of sustain electrodes extending parallel to said n scan electrodes; and n×m discharge cells, each arranged at an intersection between one of said n scan electrodes and one of said m address electrodes in one-to-one correspondence, wherein said m address electrodes are connected to m/2 first connecting points in two-to-one correspondence, and said plurality of sustain electrodes includes a first group connected to a first of two second connecting points and a second group connected to a second of said two second connecting points, said method comprising:

applying a prescribed voltage to one of said n scan electrodes;

applying another prescribed voltage in common to two of said m address electrodes connected to one of said m/2 first connecting points;

applying a first voltage to said first group; and applying a second voltage to said second group, wherein said applying a prescribed voltage, said applying another prescribed voltage, said applying a first voltage, and said applying a second voltage cause a desired discharge to select an ON state only in a first of said n×m discharge cells, wherein said first of said n×m discharge cells corresponds to said one of said n scan electrodes, a first of said two of said m address electrodes connected to said one of said m/2 first connecting points and one of said plurality of sustain electrodes of said first group to which said first voltage is applied, and a second of said n×m discharge cells, which corresponds to said one of said n scan electrodes, a second of said two of said m address electrodes connected to said one of said m/2 first connecting points and one of said plurality of sustain electrodes of said second group to which said second voltage is applied, is selected for an OFF state.

2. The method of driving an AC plasma display panel according to claim 1, wherein a first potential difference between said one of said plurality of sustain electrodes of said first group and said one of said n scan electrodes is larger than a second potential difference between said one of said plurality of sustain electrodes of said second group and said one of said n scan electrodes.

3. The method of driving an AC plasma display panel according to claim 2, wherein said second potential difference is substantially zero.

4. The method of driving an AC plasma display panel according to claim 1, wherein said first voltage and said second voltage are applied alternately to said plurality of sustain electrodes of said first group and said plurality of sustain electrodes of said second group in a period when said prescribed voltage is applied to said one of said n scan electrodes.

5. The method of driving an AC plasma display panel according to claim 1, wherein in a first addressing period, applying said first voltage and said second voltage to said first group and said second group, respectively, said prescribed voltage is successively applied to one of said n scan electrodes to select among said ON state and said OFF state in said n×m discharge cells that correspond to said plurality of sustain electrodes of said first group, after said first addressing period, in a second addressing period, applying said first voltage and said second voltage to said second group and said first group, respectively, said prescribed voltage is successively applied to one of said n scan electrodes to select among said ON state and said OFF state in said n×m discharge cells that correspond to said plurality of sustain electrodes of said second group, said method further comprising:

applying a prescribed sustain voltage to both of said first and second group, after said second addressing period, to cause sustain discharge in said n×m discharge cells that are selected for ON state in said first addressing period or said second addressing period.

6. The method of driving an AC plasma display panel according to claim 5, further comprising:

forming, after said first addressing period, first auxiliary discharge between said n scan electrodes and said m address electrodes in said n×m discharge cells that belong to said plurality of sustain electrodes of said second group in said first addressing period.

7. The method of driving an AC plasma display panel according to claim 6, further comprising:

forming, after said first addressing period, second auxiliary discharge between said n scan electrodes and said plurality of sustain electrodes of said first group in said n×m discharge cells that are selected to cause said desired discharge in said first addressing period.

* * * * *